US006290187B1

(12) United States Patent
Egami

(10) Patent No.: US 6,290,187 B1
(45) Date of Patent: Sep. 18, 2001

(54) TRAIN DETECTION APPARATUS, TRAIN-LOCATION DETECTION SYSTEM AND TRAIN-APPROACH-ALARM GENERATING APPARATUS

(75) Inventor: Noritaka Egami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/195,101

(22) Filed: Nov. 18, 1998

(30) Foreign Application Priority Data

Jun. 4, 1998 (JP) ..... 10-156380

(51) Int. Cl.[7] ..... B61L 23/34
(52) U.S. Cl. ..... 246/122 R; 246/167 R
(58) Field of Search ..... 246/122 R, 124, 246/167 R

(56) References Cited

U.S. PATENT DOCUMENTS 5,462,244 * 10/1995 Van Der Hoek et al. ..... 246/122 R
5,720,454 * 2/1998 Bchetti et al. ..... 246/34 R
5,740,547 * 4/1998 Kull et al. ..... 246/122 R
5,836,529 * 11/1998 Gibbs ..... 246/122 R

* cited by examiner

*Primary Examiner*—S. Joseph Morano
*Assistant Examiner*—Robert J. McCarry, Jr.
(74) *Attorney, Agent, or Firm*—Sughrue, Mion, Zinn, Macpeak & Seas, PLLC

(57) ABSTRACT

A band pass filter 12*a* for detecting a component in the vicinity of a frequency (1 kHz) having the highest propagation efficiency among oscillations generated when a train runs, a band pass filter 12*c* for detecting a component in the vicinity a frequency (5.5 kHz) having the lowest propagation efficiency and a microcomputer 16 are provided, the microcomputer 16 being arranged to determine a state in which the train has approached a relatively near location, a state in which the train has approached a very near location, a state in which the train has passed through and exists at a very near location or a state in which the train exists at a relatively near location. A conventional track circuit must, as a matter of course, have insulating portions for rails and incorporate a signal cable for communicating a result of the detection, causing the cost to be enlarged. The present invention is able to eliminate the foregoing necessities and reduce the cost.

8 Claims, 32 Drawing Sheets h1, h2: TRAIN-APPROACH-DETECTION APPARATUS d1 : TRAIN-PASSAGE-DETECTION/
REARWARD-TRANSMISSION APPARATUS

F2: TRAIN-DETECTION/ TRANSMISSION APPARATUS
H1, H2: TRAIN-APPROACH-ALARM GENERATING APPARATUS

TRAIN DETECTION APPARATUS, TRAIN-LOCATION DETECTION SYSTEM AND TRAIN-APPROACH-ALARM GENERATING APPARATUS

BACKGROUND OF THE INVENTION

The present invention relates to a train detection apparatus for detecting the location of a train which is running on rails and a train-location detection system having a plurality of the apparatuses disposed along the rails.

Detection of the locations of a train is of importance for the railway operation for the purpose of performing safety operation. For example, information that a train is approaching is required to control railroad crossings to open/close, control points disposed in a forward station, guidance for passengers and assure safety of operators. Information that a train has passed and moved away is required for the operation of following trains.

The railway system in which trains having steel wheels run on steel rails is usually adapted a method called a "track circuit" for detecting the location of a train. The track circuit is structured so that two ends of two rails disposed in parallel and used in a pair are electrically insulated from one another. Moreover, a predetermined voltage is always applied to a position between the two rails. When wheels joined to the two ends of a steel wheel shaft are placed on the circuit, the two parallel rails are electrically short-circuited. Thus, the voltage between the two rails is made to be zero. The foregoing fact is used to detect whether or not a train exists.

When the above track circuit is employed, the rails must be cut at required intervals so as to electrically insulate the rails from each other. However, the long rails each having several kilometers and taken for granted today encounters a limit of the maximum lengths. Moreover, special joints called "expansion joints" are required, thus causing the cost to be enlarged. What is worse, there is apprehension that an accident happens such that the travel of the train is obstructed because of an electrical insulation failure occurring in the insulated portion.

To overcome the problem experienced with the conventional track circuit, a train detection method using a sound wave which propagates through the rail has been disclosed in, for example, Japanese Patent Laid-Open No. 10-02951.

FIG. 1 is a block diagram showing a conventional train-approach-detection apparatus disclosed in Japanese Patent Laid-Open No. 10-002951 and using a sound wave. FIG. 1 shows a state in which a train 2 runs on rails 1 in a direction indicated by an arrow. Reference numerals h1 and h2 represent the train-approach-detection apparatuses which have corresponding acceleration sensors S1 and S2 and magnetostrictive oscillators M1 and M2 which are connected to the rails 1. The acceleration sensors S1 and S2 detect oscillations of the rails 1, while the magnetostrictive oscillators M1 and M2 transmit sound waves to the rails 1.

The operation of the foregoing conventional train-approach-detection apparatus will now be described. The train-approach-detection apparatus h1 operates the magnetostrictive oscillator M1 to transmit a sound wave having a specific frequency to the rail 1. A sound wave reflected by the train 2 is received by the acceleration sensor S1. The train-approach-detection apparatus hi measures required time to multiply the measured time by a known propagation speed of a sound wave through the rail 1 so that the distance to the train 2 is calculated.

Since the train 2 is always moved, the train-approach-detection apparatus h1 repeats the foregoing process at predetermined time intervals so as to always detect the location of the train 2. Also the train-approach-detection apparatus h2 performs a process similar to the process which is performed by the train-approach-detection apparatus h1 so as to always detect the location of the train 2.

If the train-approach-detection apparatuses h1 and h2 are disposed apart from each other for a relatively short distance, for example, several hundred meters, incorrect recognition and overlap of the sound waves take place between the two train-approach-detection apparatuses h1 and h2 in a case where the frequency of the sound waves which are employed by the two train-approach-detection apparatuses h1 and h2 are the same. In this case, the distance cannot accurately be measured. Therefore, the frequencies of the sound waves which are employed by the two train-approach-detection apparatuses h1 and h2 must be different from each other. Since a fact has been found that frequencies included in a relatively narrow range is easy to be propagated through the rail 1, the two train-approach-detection apparatuses h1 and h2 must use substantially the same frequencies. Therefore, the conventional train-approach-detection apparatuses h1 and h2 mist be disposed apart from each other at a considerably long distance.

Even if the train is detected by the above-mentioned method, the conventional apparatus must have signal cable arranged along the rail so as to commutate a result of the detection to another apparatuses. Thus, a railway company must bear a great cost. The foregoing cable can easily be gnawed and damaged by mice. To prevent the damage, another large cost is required What is worse, the travel of the train is obstructed.

The sound waves which are generated by the magnetostrictive oscillators M1 and M2 are mainly composed of elastic waves. If the rail 1 is hit with a hammer, elastic waves having frequencies in a relatively wide range are generated. Therefore, the frequencies of sound waves which is easy to be propagated through the rail 1 were examined.

Waveforms of sound waves (elastic waves) measured at points apart from a position at which the rail 1 was hit by the hammer at distances of 50 m and 150 m by an acceleration sensor and results of Fourier transformation were shown in graphs in FIGS. 2A, 2B, 3A and 3B. As can be understood from FIG. 2, sound waves (elastic waves) having frequencies in a relatively wide range exist at the position 50 m away from the hit point. As can be understood from FIG. 3, a fact can be understood that sound waves (elastic waves) having frequencies near 3 kHz intensely remains at the position 150 m apart from the hit point. Although a fact has theoretically been found that the frequency of the sound wave (the elastic wave) which is easy to be propagated through the rail 1 considerably depends on the intervals of sleepers, a fact was found that only sound waves having the frequencies near the base frequency (which as 3 kHz) were easily propagated.

As described above, the train detection method using sound waves in place of the conventional track circuit encounters the problem in that the distance to the train cannot be detected or incorrect detection is performed if the two apparatuses are disposed apart from each other at a relatively short distance.

BRIEF SUMMARY OF THE INVENTION

In view of the foregoing, an object of the present invention is to provide a train detection apparatus, a train-location detection system and a train-approach-alarm generating apparatus which are not required to provide insulating portions for rails, which enable apparatuses to be disposed at relatively short intervals and which are free from a necessity of arranging a signal cable for communicating a result of the detection.

The train detection apparatus according to the present invention is arranged to receive and detect a component of frequencies (frequencies having the highest propagation efficiency in actual) having a relatively high propagation efficiency and a component of frequencies having a relatively low propagation efficiency (frequencies having the lowest propagation efficiency in actual). In accordance with a result of the detection, a state in which a train has approached a very near location or a state in which the train has approached a location more distant than a very near location can be detected Moreover, thus-obtained information about the location of the train is formed into a sound wave signal which is transmitted through the rail so that information above is communicated among a plurality of apparatuses by a so-called bucket brigade method.

Since the above-mentioned structures cannot detect a train which is running at a very low speed and which does not substantially generate oscillations of the rails or a train which is stopped and which does not generate oscillations, a sound wave signal is transmitted to the rail so as to positively detect the existence of the train.

The train-approach-alarm generating apparatus according to the present invention is structured by employing the above-mentioned train detection apparatus.

The train-location detection system according to the present invention has a structure that a plurality of the above-mentioned train detection apparatuses are disposed along the rail so as to detect the approach and passage of a train and the location of the train is communicated to the train detection apparatuses disposed forwards and rearwards in a direction in which the train runs. Thus, the location of the train can continuously be detected.

The train-location detection system according to the present invention is structured so that thus-obtained information about the location of the train is formed into a sound wave signal which is propagated through the rail so that information above is communicated among a plurality of the apparatuses by the so-called bucket brigade method.

Since the above-mentioned structures cannot detect a train which is running at a very low speed and which does not substantially generate oscillations of the rails or a train which is stopped and which does not generate oscillations, the train-location detection system according to the present invention is arranged so that a sound wave signal is transmitted to the rail so as to positively detect the existence of the train.

The train-approach-alarm generating apparatus according to the present invention employs the respective technologies of the aforementioned detection systems.

The above and further objects and features of the invention will more fully be apparent from the following detailed description with accompanying drawing.

DESCRIPTION OF THE PREFERRED EMBODIMENTS

Principle of Invention

Figure 4B:
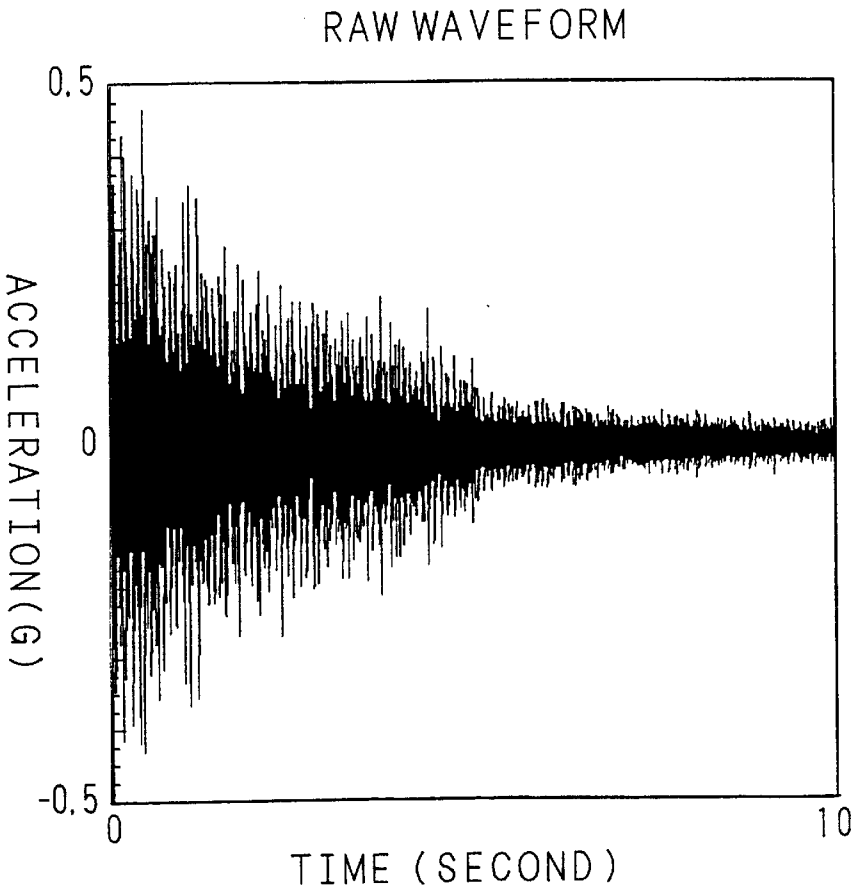
FIG. 4B is a graph showing frequency spectrum of the waveform.
Figure 4A:
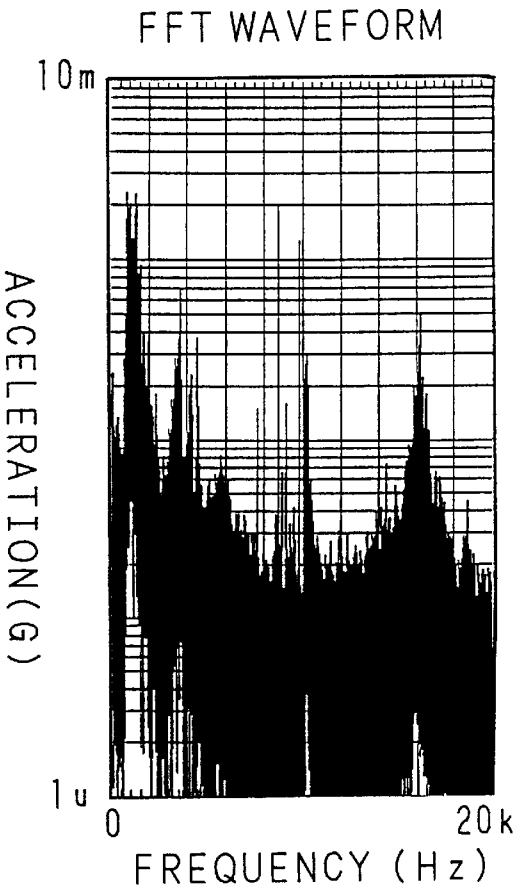
FIG. 4A is a graph showing a raw waveform of acceleration measured five seconds after a train running at about 35 km has passed through a measuring point.

Initially, the principle of the present invention will now be described As a matter of course, rails are oscillated when a train runs on the rails. The oscillations are propagated to a certain distance through the rails which serve as mediums. FIGS. 4A and 4B are graphs showing examples of raw waveforms (FIG. 4B) of acceleration and frequency spectrums (FIG. 4A) measured five seconds after a train running at about 35 km has passed through a measuring point.

Figure 3B:
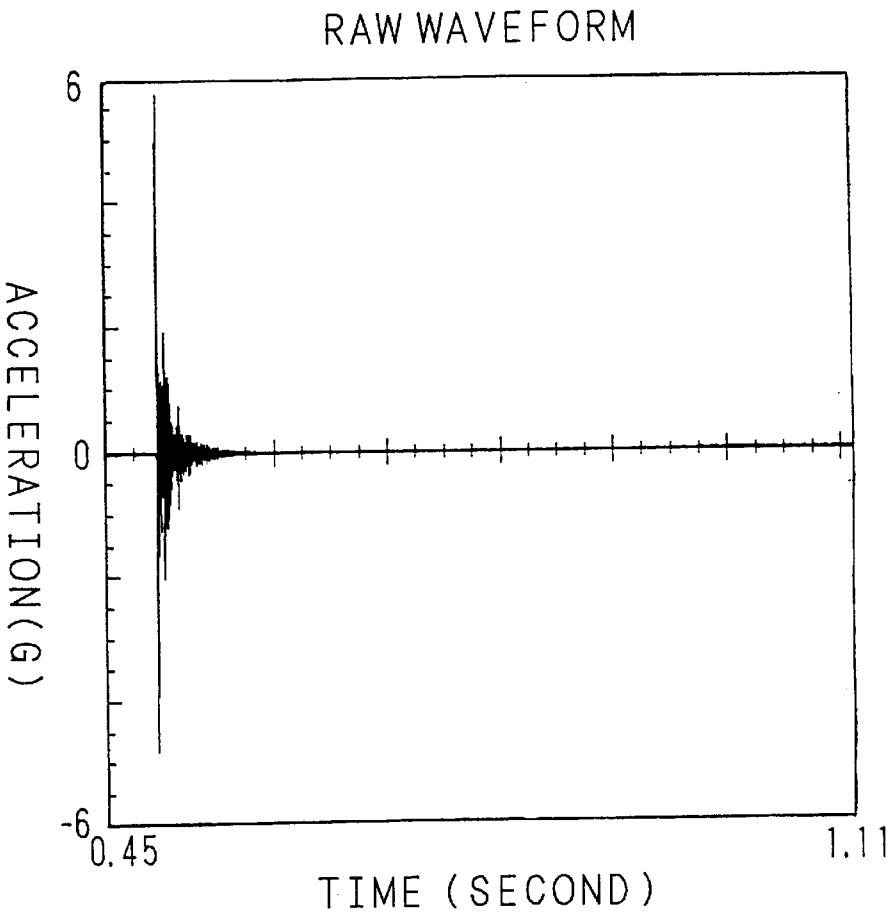
FIG. 3B PRIOR ART
FIG. 3B is a schematic view of a graph showing results of Fourier transformation of the obtained results.
Figure 3A:
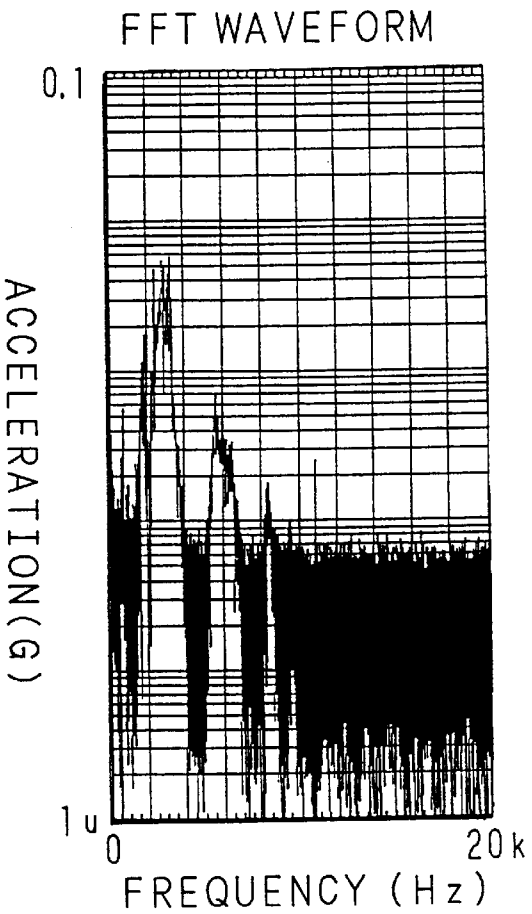
FIG. 3A PRIOR ART
FIG. 3A is a schematic view of a graph showing waveforms (elastic waves) measured by the acceleration sensors at the positions apart from a hit point at a distance of 50 m and 150 m when a rail has been hit with a hammer.

As can be understood from FIG. 4, oscillations having frequencies in the vicinity of 1 kHz are the main component of the oscillations. When the rail shown in FIG. 3 is hit with a hammer, oscillations having the frequencies in the vicinity of 3 kHz is easy to be propagated. Oscillations which are generated when a train runs on rails are different from elastic waves which are generated by the hammer or a magnetostrictive oscillator. In accordance with the structure of the rail, flexural oscillations are considered the main component of the foregoing oscillations.

Figure 1:
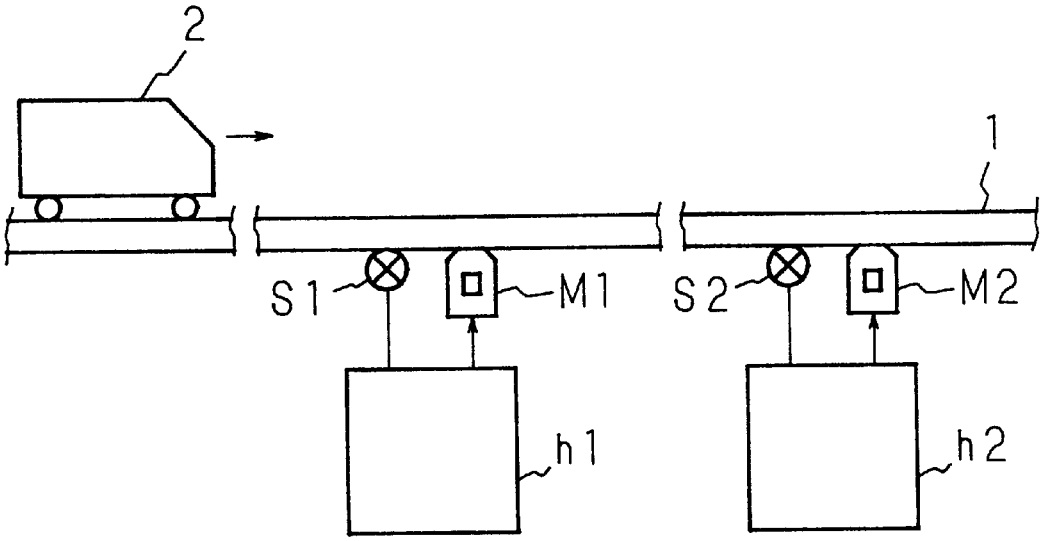
FIG. 1 PRIOR ART
FIG. 1 is a block diagram showing an example of the structure of a conventional train-approach-detection apparatus using a sound wave.
Figure 2B:
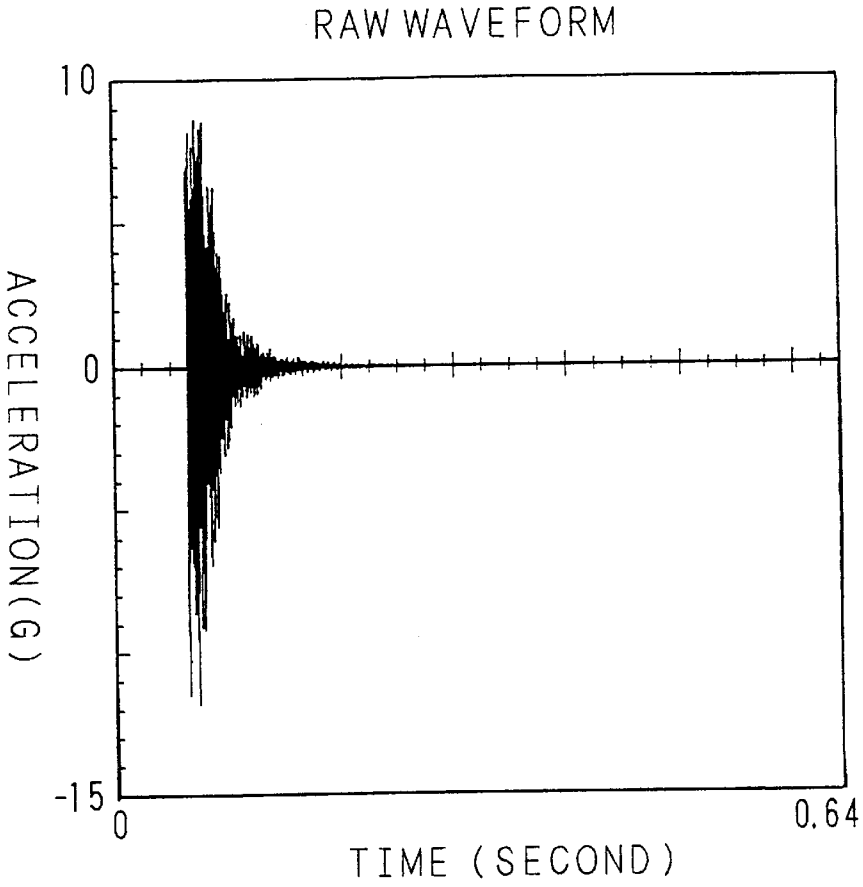
FIG. 2B PRIOR ART
FIG. 2B is a schematic view of a graph showing results of Fourier transformation of the obtained results.
Figure 2A:
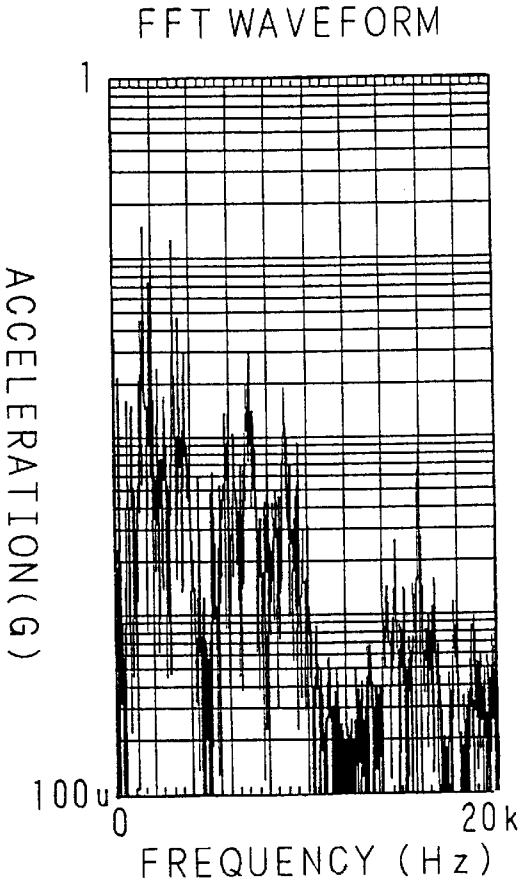
FIG. 2A PRIOR ART
FIG. 2A is a schematic view of a graph showing waveforms (elastic waves) measured by acceleration sensors at positions apart from a hit point at a distance of 50 m and 150 m when a rail has been hit with a hammer.

When FIG. 2 and FIG. 4 are subjected to a comparison, elastic waves generated by the hammer are in the form of pulses and disappear in a short time (for example, about 0.1 second in the case shown in FIG. 2). On the other hand, the flexural oscillations generated by the rail continue for a relatively long time. Therefore, a determination is permitted such that a running train approaches (within several hundred meters) if acceleration signals not lower than a predetermined threshold value continue as a result of measurement of acceleration signals in the vicinity of 1 kHz.

Figure 5B:
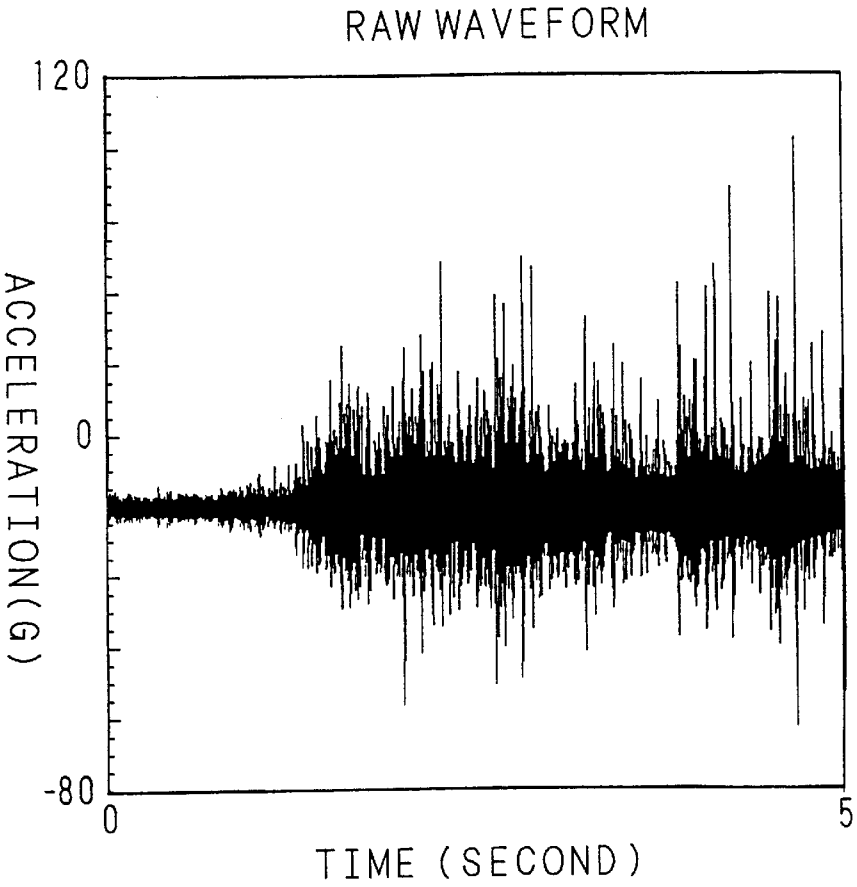
FIG. 5 is a graph showing a raw waveform and its frequency spectrum of acceleration realized when measurement has been started immediately before the train running at about 35 km passes through the measuring point.
Figure 5A:
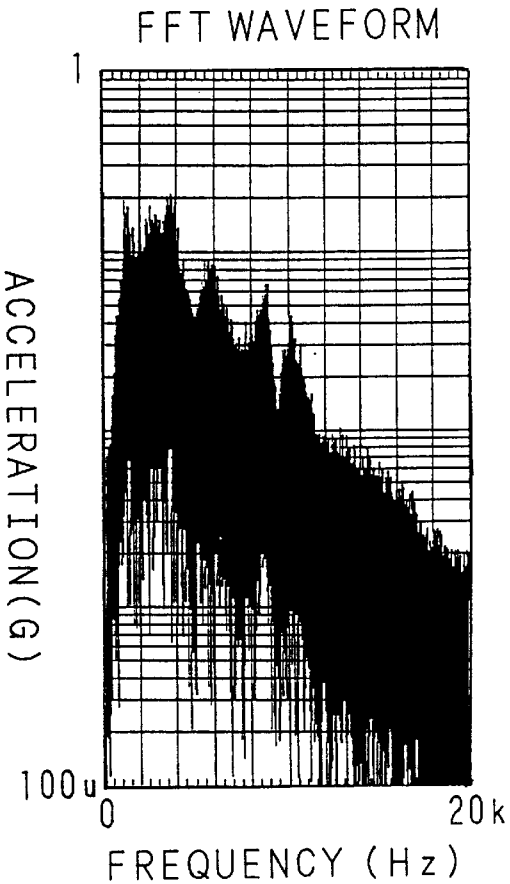
Figure 6:
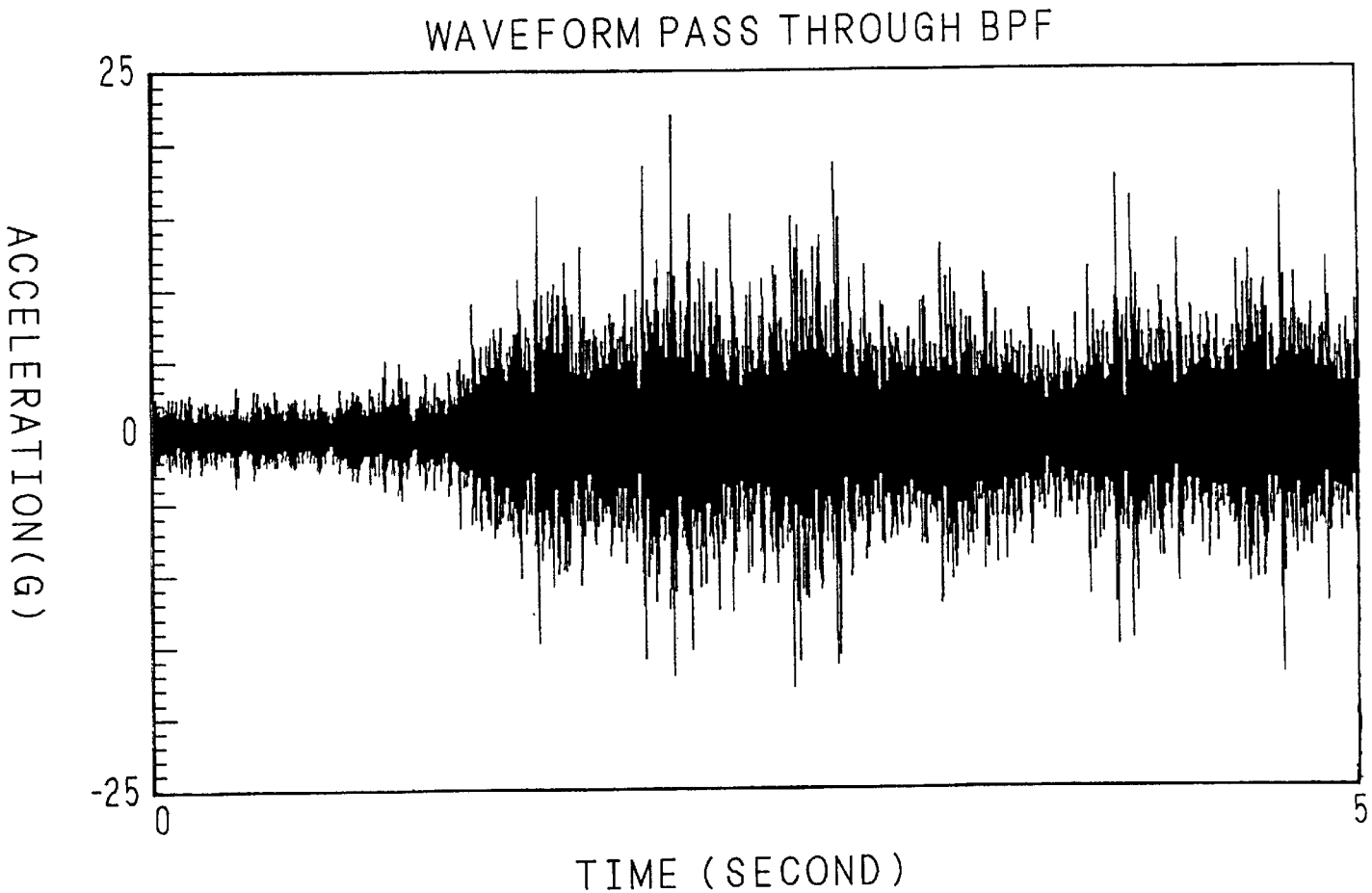
FIG. 6 is a graph showing a waveform realized after the raw waveform shown in FIG. 5 has been allowed to pass through a band pass filter set to 500 Hz to 2000 Hz.
Figure 7:
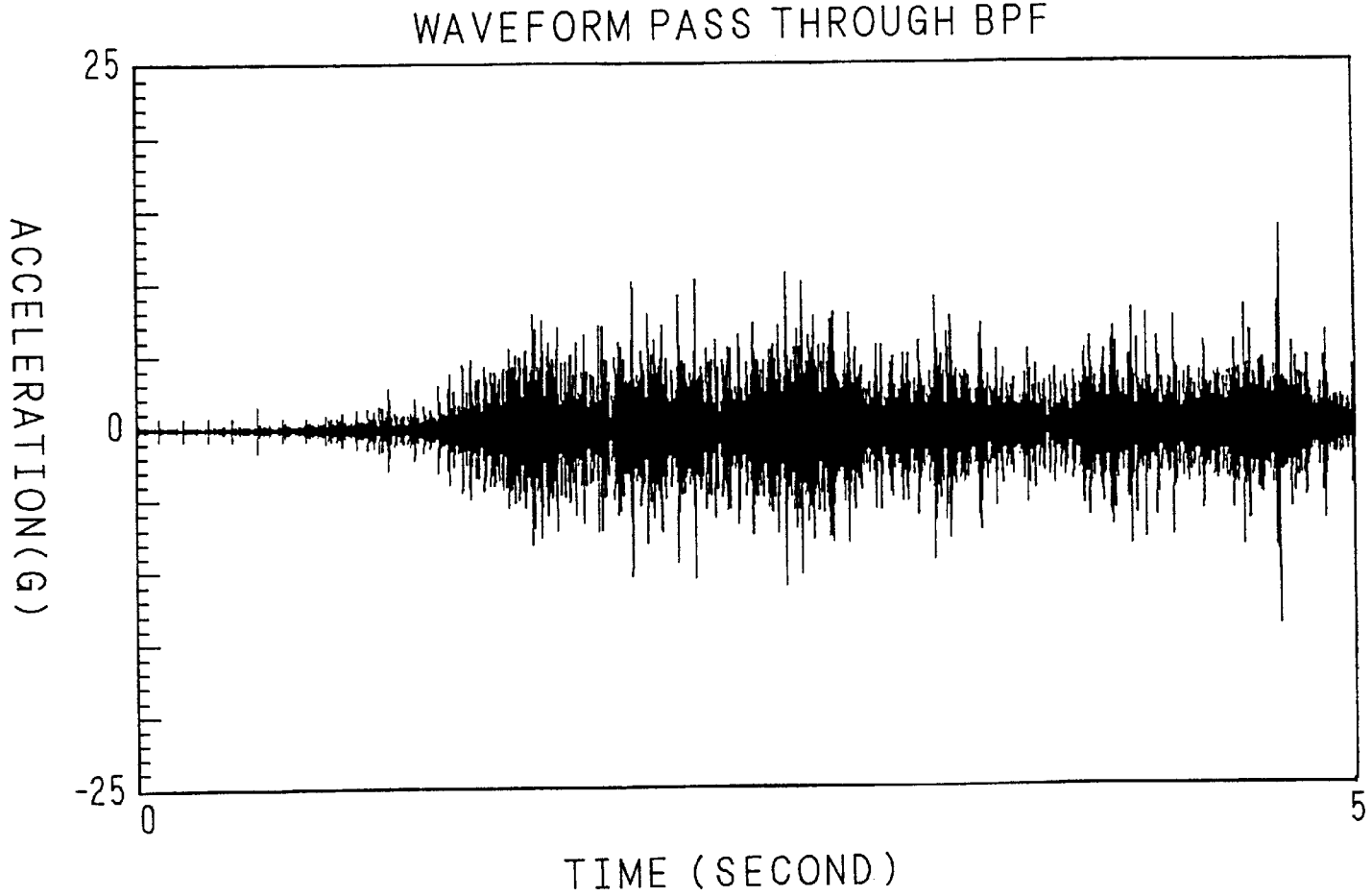
FIG. 7 is a graph showing a waveform realized after the raw waveform shown in FIG. 5 has been allowed to pass through a band pass filter set to 5000 Hz to 6000 Hz.

A determination which is made if a running train furthermore approaches, for example, if the train approaches within the distance of 10 m to 20 m from the measuring point will now be described. FIG. 5 is a graph showing raw waveforms (FIG. 4B) of acceleration and frequency spectrums (FIG. 4A) obtained when measurement has been started immediately before a train running at about 35 km passes through the measuring point. FIG. 6 is a graph showing a waveform obtained by causing the waveforms to pass through a band pass filter set to 500 Hz to 2000 Hz. FIG. 7 is a graph showing a waveform obtained by causing the waveforms to furthermore pass through a band pass filter set to 5000 Hz to 6000 Hz.

Since the waveform shown in FIG. 6 includes components of oscillations generated by the running train in the vicinity of 1 kHz which is most easy to be propagated through the rail, the distance attenuation of the signal, that is, the attenuation corresponding to about 35 with respect to one second and shown in FIG. 6 is considerably restrained. Since only component in the vicinity of the frequencies which is difficult to be propagated are contained in the case shown in FIG. 7, a conspicuous attenuation takes place. Therefore, if observed frequencies of oscillations which is difficult to be propagated and which are not smaller than a predetermined threshold value are continued, it can be considered that a running train exists in the proximity of 10 m to 20 m.

As described above, oscillations generated by a running train and having the frequencies which is most easy to be propagated, for example, those in the vicinity of 1 kHz when the intervals of sleepers are about 60 cm and oscillations having the frequencies which is difficult to be propagated, for example, those in the vicinity of 5.5 kHz are measured. Then, results of the measurements are combined with one another so that detection is performed so that a running train approaches and reaches in the proximity of the measuring point or detection from immediately after passage to movement to a location a certain distance away from the location is performed.

Although the intensity of oscillations changes depending on the type of the running train and the running speed of the train, a running train generates oscillations having various frequencies. Therefore, the continuation with time of signals having certain intensities (not less than a certain threshold value) is paid attention so that the location of a running train is detected.

When a rail is artificially oscillated with a hammer, a stone or the like, oscillations are formed into pulses having no continuity with time as described above. Therefore, the foregoing oscillations can easily be distinguished from oscillations generated by a train. Therefore, so,called hindrance of a train can easily be prevented Since detection cannot be performed by only the above-mentioned passive detection of oscillations in a state in which a train does not generate oscillations, for example, in a state in which the train is stopped or in a state in which the train runs at a low speed. Measures to be taken against the above-mentioned case will be described in the embodiment to be described later.

Then, the principle of transmitting data using a sound wave will now be described. In the present invention, a sound wave signal is used to transmit data through the rail. As described above, oscillations generated by a running train exists as intense noise as compared with the sound wave signal. In particular, considerably intense noise exists immediately before and after the passage of the train through the position at which the apparatus is disposed Even in the foregoing environment, data transmission using a sound wave (an elastic wave) can be performed because of the following principle.

Figure 8:
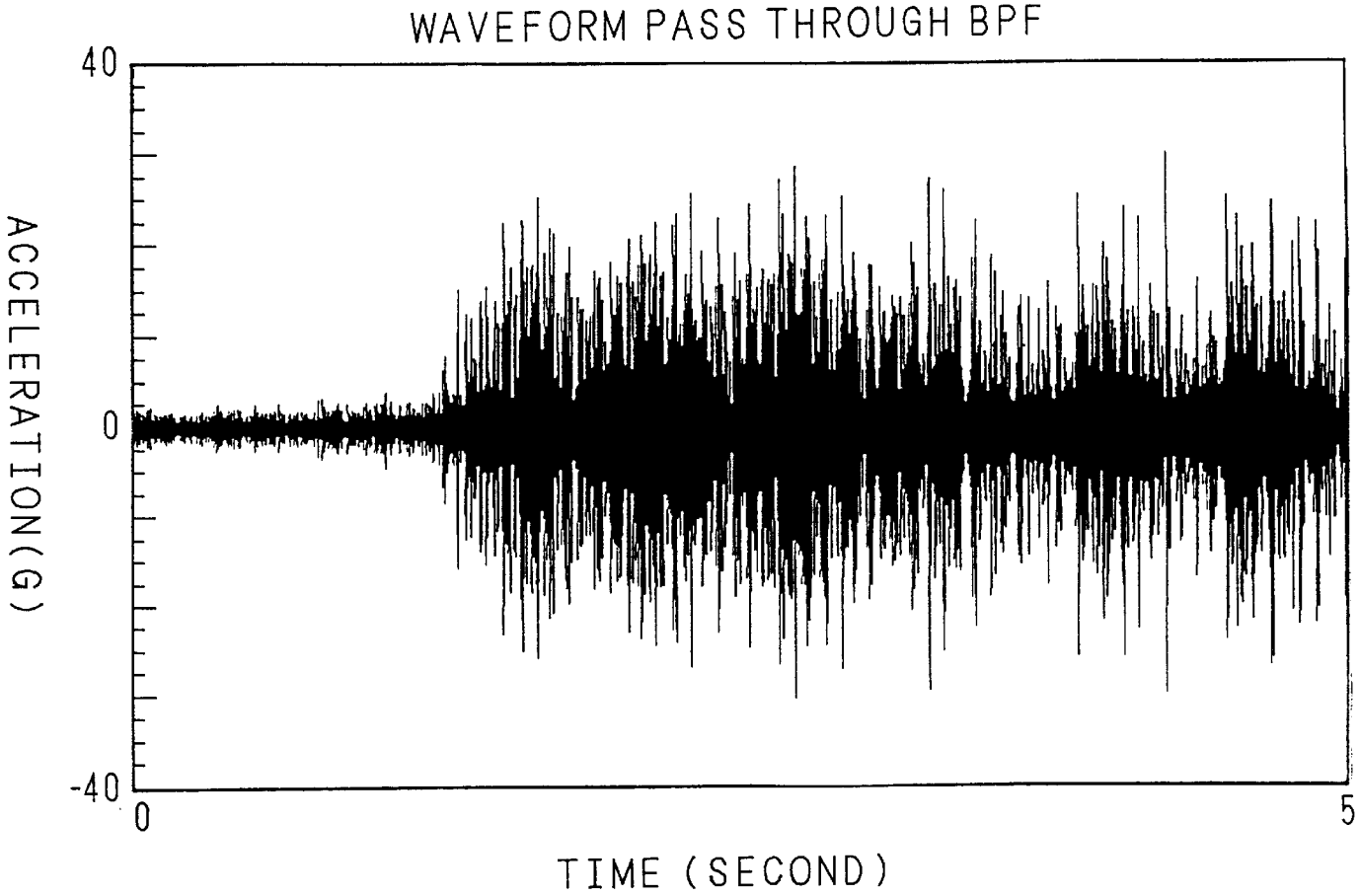
FIG. 8 is a graph showing a waveform realized after the raw waveform shown in FIG. 5 has-been allowed to pass through a bandpass filter set to 2500 Hz to 4000 Hz.

FIG. 8 is a graph showing a waveform realized after the waveform data shown in FIG. 5 has been allowed to pass through a filter set to 2500 Hz to 4000 Hz. As can be understood from FIG. 8, the acceleration of the oscillations having the frequency in the vicinity of 3000 Hz and adjacent to the train is 10 Gp-p or smaller and the amplitude of the oscillations is $\gamma=10\times9.8\ m/s^2/(2\pi3000)^2\approx0.3\ \mu m$ or shorter.

Since the magnetostrictive oscillator is distorted by tens of $\mu$m when the magnetostrictive oscillator has a length of 20 cm, the rail can easily be oscillated with an amplitude of tens of $\mu$m. That is, if the magnetostrictive oscillator is employed, the rail can be oscillated with elastic waves of about 100 Gp-p which is considerably larger than oscillations which are generated by the train.

As described above, use of the magnetostrictive oscillator enables elastic waves having a specific frequency which can be easily propagated through the rail, specifically the frequencies in the vicinity of 3 kHz when the intervals of sleepers are about 60 cm to be applied to the rail with an intensity greater than the oscillations which are generated by the train. Therefore, data transmission using the sound wave (the elastic wave) as a signal and using the rail as a propagation medium can be performed.

The train detection apparatus, the train-location detection system and the train-approach-alarm generating apparatus according to the present invention detect a train in accordance with the above-mentioned principle. Embodiments will now be described with reference to the drawing.

In the following embodiments, "a running train is at a near location (within several hundred meters)" and "a train is at a very near location (within 10 m to 20 m)" are the following states: the former state is a state in which the levels of oscillations having frequencies in the vicinity 1 kHz are continuously high. The latter state is a state in which the levels of oscillations having a frequency of 5.5 kHz are continuously high in the state in which the levels of oscillations having frequencies in the vicinity 1 kHz are continuously high. Therefore, "within a first predetermined distance which is a very short distance" is 10 meters to 20 meters and the "second predetermined distance" is aforementioned several hundred meters.

First Embodiment

Figure 9:
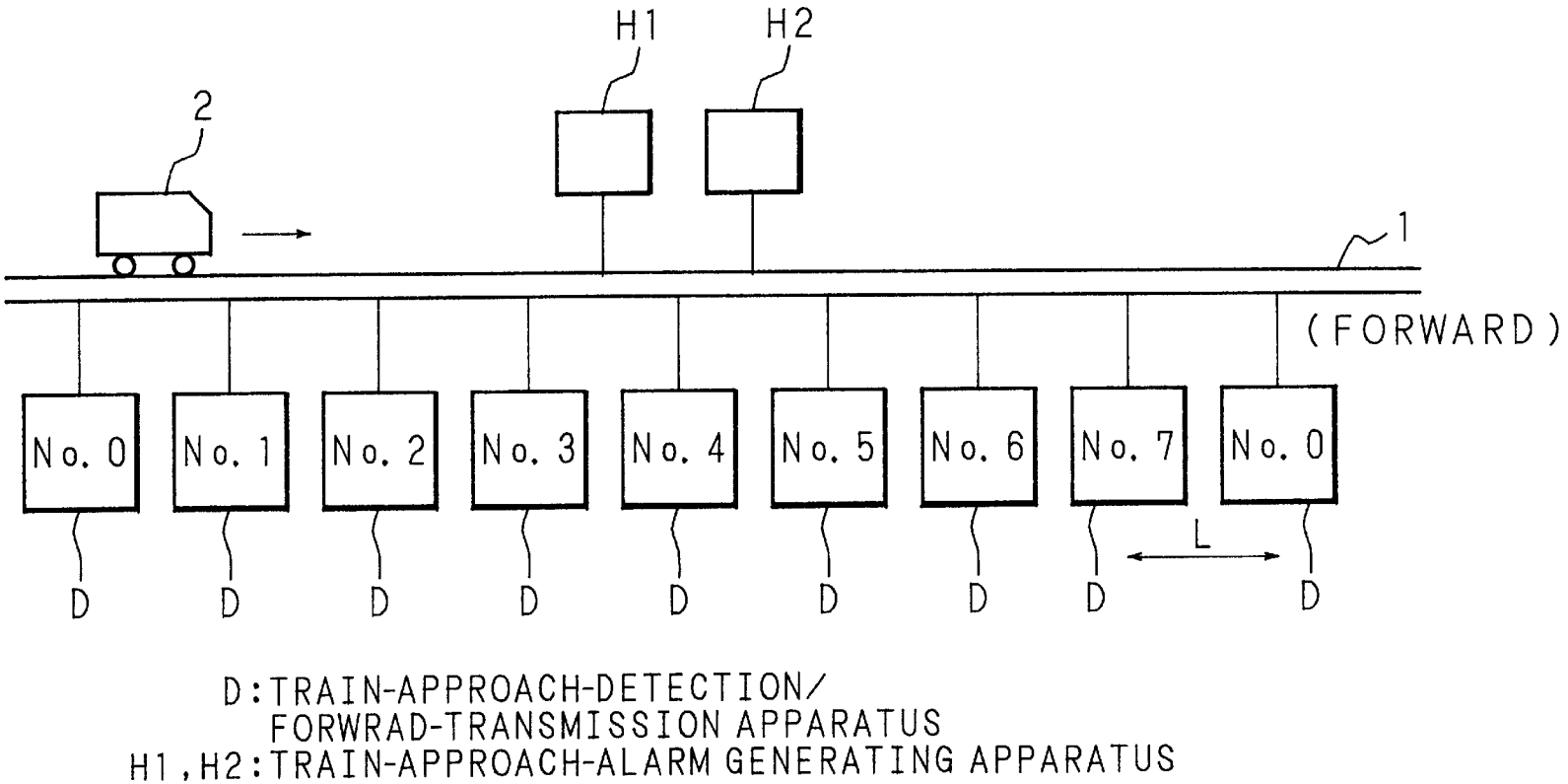
FIG. 9 is a schematic view showing an example of the overall structure of a first embodiment of a train-location detection system according to the present invention.

FIG. 9 is a schematic view showing an example of the overall structure of a first embodiment of a train-location detection system according to the present invention.

FIG. 9 shows a state in which a train 2 runs on rails 1 in a direction indicated by an arrow. Symbol D represents a train-approach-detection/forward-transmission apparatus. Seven train-approach-detection/forward-transmission apparatuses D are repeatedly given No. 0 to No. 7 (hereinafter called "station Nos."). The train-approach-detection/forward-transmission apparatuses D are disposed at predetermined intervals of about 500 m along the rails 1. Reference numerals H1 and H2 represent portable train-approach-alarm generating apparatuses which are temporarily joined to the rail 1 when an operation is performed by track maintenance operators.

Figure 10:
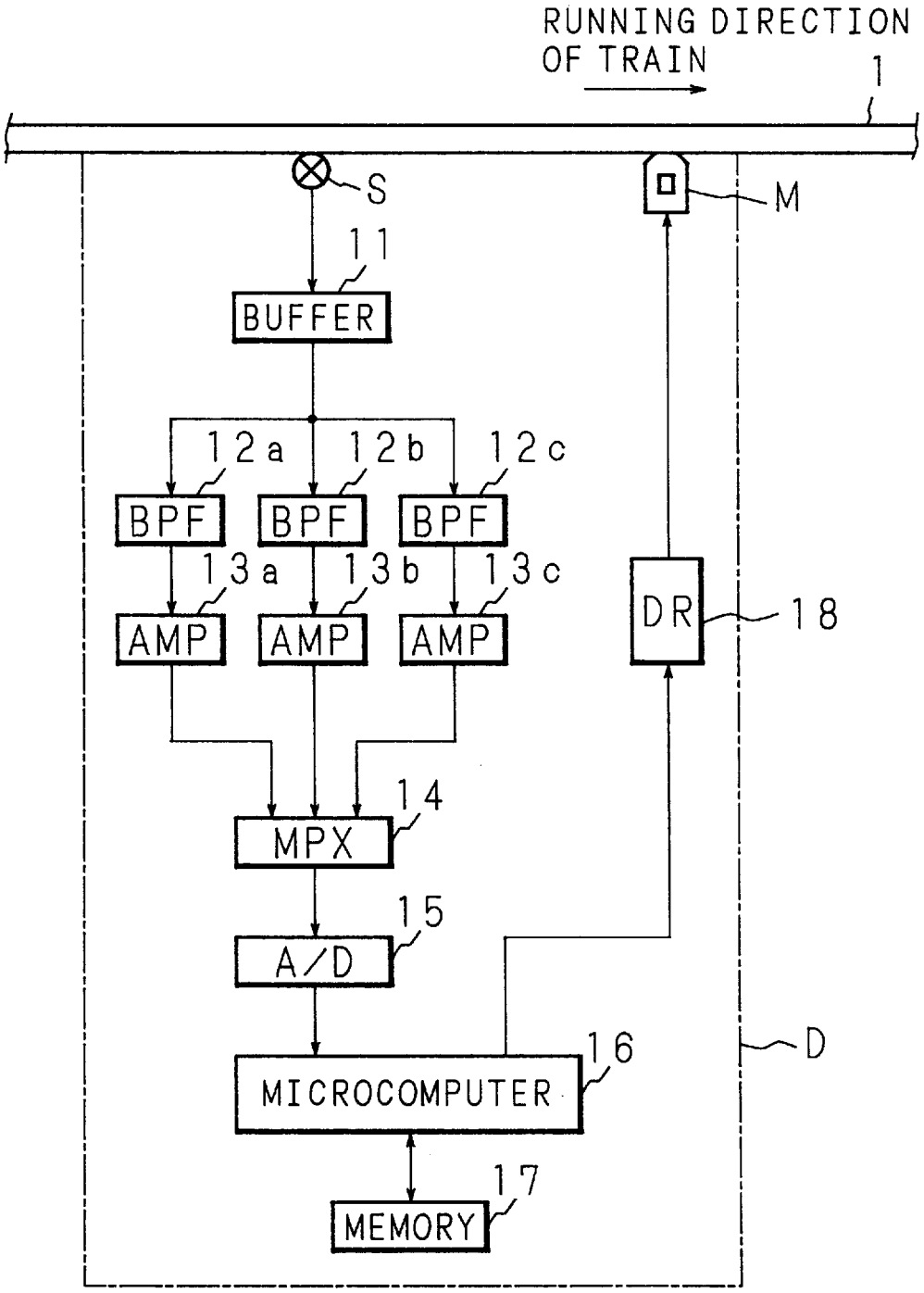
FIG. 10 is a block diagram showing an example of the structure of each train detection apparatus of the first embodiment of the train-location detection system according to the present invention.
Figure 11:
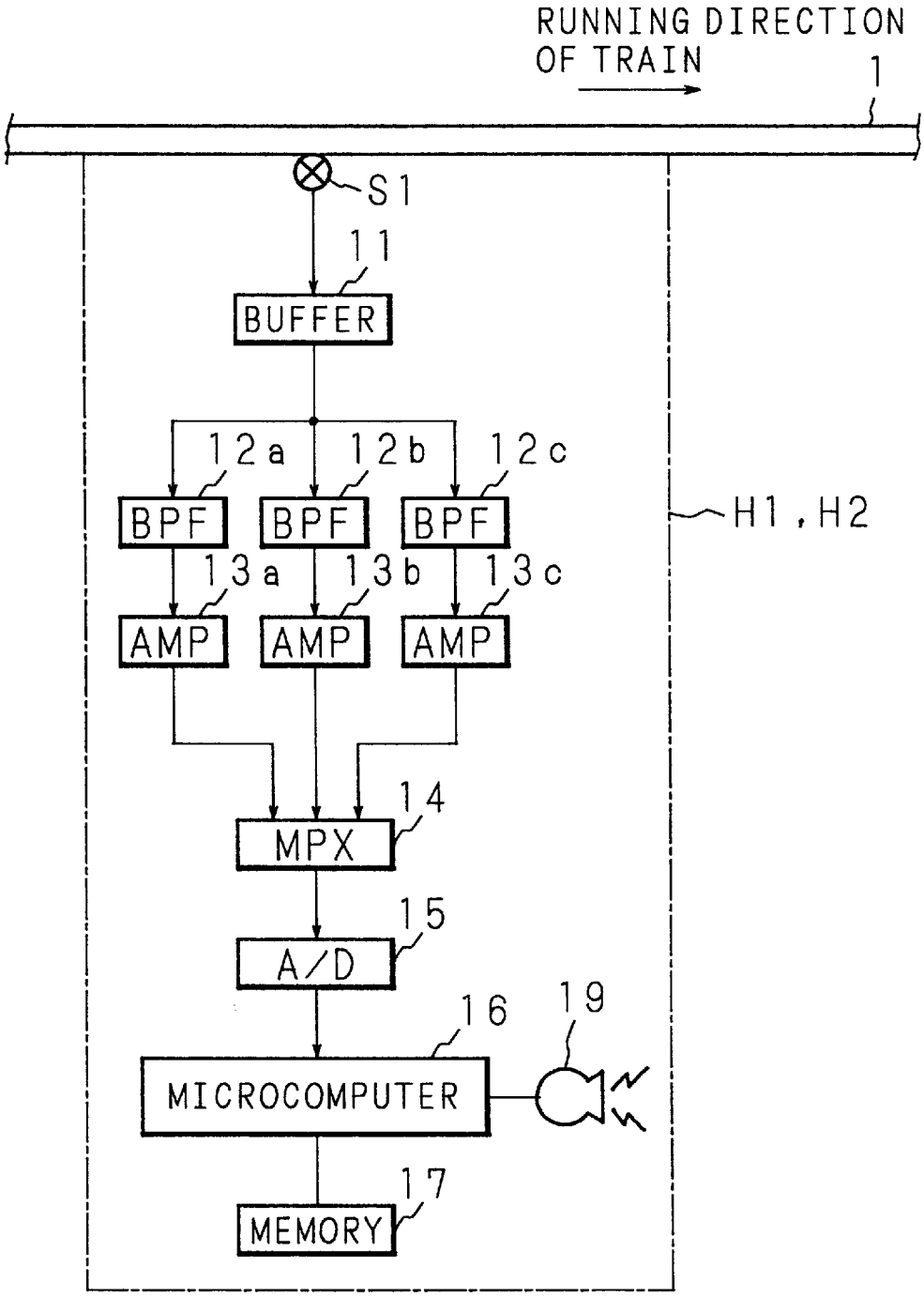
FIG. 11 is a block diagram showing an example of the structure of each train-approach-alarm generating apparatus of the first embodiment of the train-location detection system according to the present invention.

FIG. 10 is a block diagram showing each train-approach-detection/forward-transmission apparatus D constituting the train location detection system according to the present invention. FIG. 11 is a block diagram showing an example of the train-approach-alarm generating apparatuses H1 and H2 which have basically the same structures.

Referring to FIG. 10, symbol S represents an acceleration sensor connected and joined to the rail 1 and M represents a magnetostrictive oscillator connected and joined to the rail 1. The acceleration sensor S detects the oscillations of the rail 1, while the magnetostrictive oscillator M applies a sound wave (an elastic wave) to the rail 1.

The acceleration sensor S detects the oscillations of the rail 1 and transmits a corresponding analog electric signal. The analog electric signal is, through a buffer amplifier 11, supplied to three band pass filters (BPF) 12*a*, 12*b* and 12*c* having individual band characteristics. The outputs of the band pass filters 12*a*, 12*b* and 12*c* are amplified by corresponding amplifiers (AMP) 13*a*, 13*b* and 13*c* connected to the band pass filters 12*a*, 12*b* and 12*c*, and then supplied to an analog multiplexer (MPX) 14. The analog multiplexer 14 repeatedly produces outputs of the inputs from the amplifiers 13*a*, 13*b* and 13*c* to the A/D converter 15 at predetermined periods. The A/D converter 15 converts the signal supplied from the multiplexer 14 into a digital signal, and then supplies the digital signal to the microcomputer 16. A memory 17 is connected to the microcomputer 16.

The magnetostrictive oscillator M is connected to the microcomputer 16 through a drive circuit 18. When the microcomputer 16 operates and controls the drive circuit 18 so that the magnetostrictive oscillator M is distorted. Thus, oscillations of a sound wave are applied to the rail 1.

The train-approach-alarm generating apparatuses H1 and H2 shown in FIG. 11 have a structure that the drive circuit 18 and the magnetostrictive oscillator M are omitted from the structure of the train-approach-detection/forward-transmission apparatus D shown in FIG. 10. As an alternative to this, a buzzer 19 which is operated under control of the microcomputer 16 is provided. The acceleration sensor S of the train-approach-detection/forward-transmission apparatus D is semi-permanently joined to the rail 1. The acceleration sensors S1 of the train-approach-alarm generating apparatuses H1 and H2 are joined to the rails 1 in the field to be manually detachable.

The train-approach-detection/forward-transmission apparatus D and the train-approach-alarm generating apparatuses H1 and H2 which constitute the train detection apparatus according to the present invention detect the train 2 on the basis of the above-mentioned principle. The operation of the apparatus will now be described with reference to a flow chart showing the process of the operation of the microcomputer 16 for controlling the train-approach-detection/forward-transmission apparatus D and the train-approach-alarm generating apparatuses H1 and H2 having structures as shown in FIG. 9.

The band pass filters 12*a*, 12*b* and 12*c* are narrow band pass filters. The band pass filter 12*a* permits passage of frequencies in the vicinity of 1 kHz which is most easy to be propagated among oscillations generated by the train 2. The band pass filter 12*b* permits passage of frequencies in the vicinity of 3 kHz which is most easy to be propagated among sound waves (elastic waves) generated by the magnetostrictive oscillator M. The band pass filter 12*c* permits passage of frequencies (the frequencies in the vicinity of 5.5 kHz in this case) having the greatest distance attenuation among oscillations generated by the train 2.

The oscillation signal detected by the acceleration sensor S is allowed to pass through the buffer amplifier 11, the band pass filters 12*a*, 12*b* and 12*c* and the amplifiers 13*a*, 13*b* and 13*c*, and then supplied to the multiplexer 14. The multiplexer 14 transmits the signals supplied from the amplifiers 13*a*, 13*b* and 13*c*. That is, the multiplexer 14 sequentially transmits, to the A/D converter 15, the signals allowed to pass through the band pass filters 12*a*, 12*b* and 12*c* while the multiplexer 14 switches the signals at predetermined periods.

The A/D converter 15 converts the signals supplied from the multiplexer 14 into digital signals, and then supplies the digital signals to the microcomputer 16. The microcomputer 16 processes the digital signals in a quantity corresponding to a latest period of time, for example, one second, while the microcomputer 16 stores the signals in a memory 17. Specifically, the microcomputer 16 subjects the signals to a comparison with a predetermined threshold value. Thus, the microcomputer 16 detects the train 2 and performs data transmission using sound waves.

Figure 12:
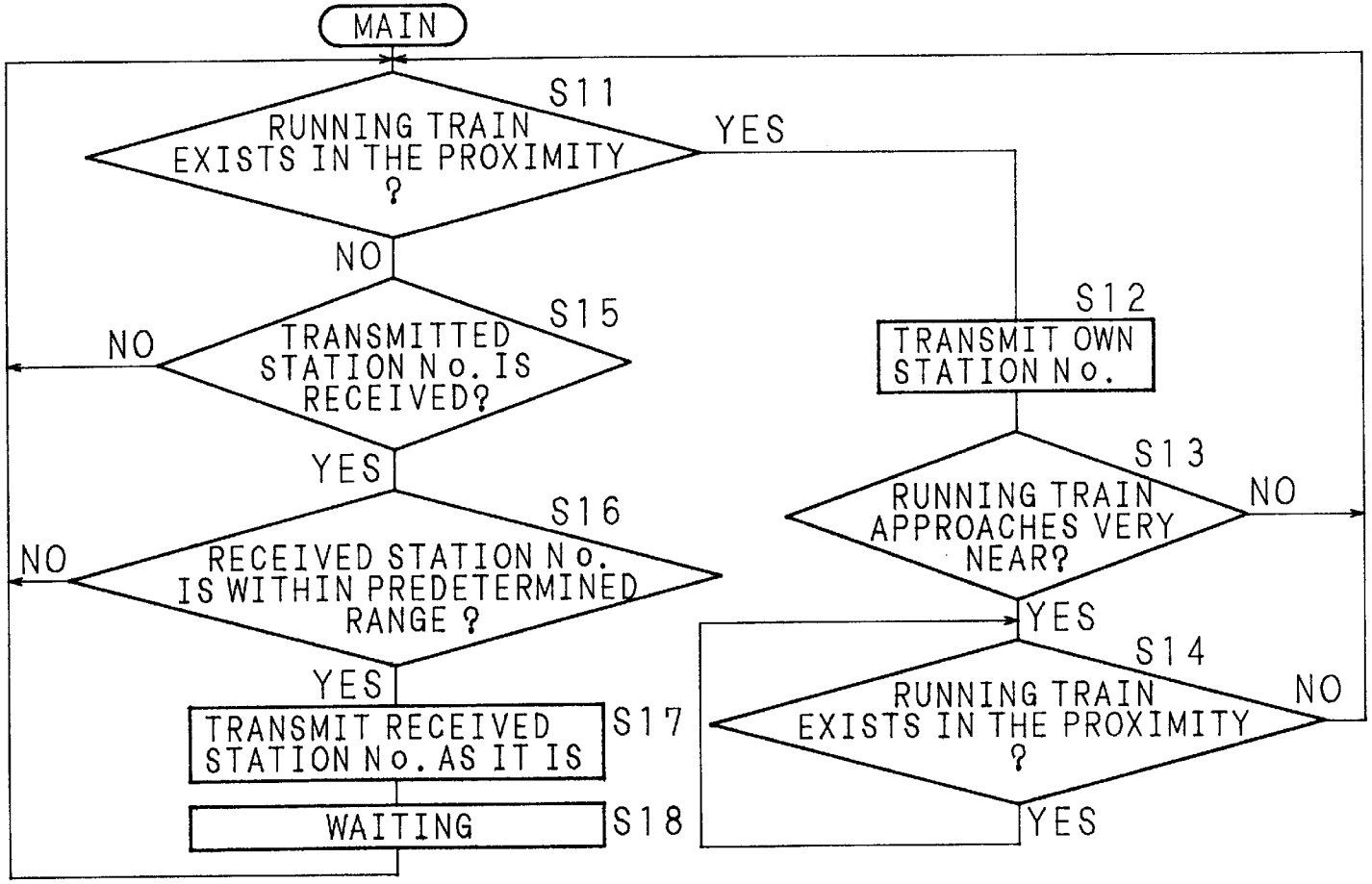
FIG. 12 is flow chart showing a process of control which is performed by a microcomputer of the train detection apparatus of the first embodiment of the train-location detection system according to the present invention.

If the train 2 is approaching the No. 1 train-approach-detection/forward-transmission apparatus D as shown in FIG. 9, the microcomputer 16 of the No. 1 train-approach-detection/forward-transmission apparatus D performs control in accordance with a flow chart shown in FIG. 12.

When the train 2 approaches, the signals having the frequencies in the vicinity of 1 kHz increase. If the foregoing signals continuously exceed a predetermined threshold value, the microcomputer 16 of the No. 1 train-approach-detection/forward-transmission apparatus D determines that the running train 2 exists in the proximity ("YES" in step S11). The foregoing determination is performed in accordance with the predetermined threshold value with which a determination is made that the oscillations having frequencies in the vicinity of 1 kHz becomes large when the train 2 has approached a location corresponding to a half distance of the interval L (which is about 500 m in the first embodiment) between the train-approach-detection/forward-transmission apparatuses D.

When approach of the train 2 has been detected, the microcomputer 16 controls the drive circuit 18 to transmit data of its train-approach-detection/forward-transmission apparatus D having the corresponding number to the magnetostrictive oscillator M as a sound wave (an elastic wave) signal (step S12). The sound wave (the elastic wave) signal is transmitted so that a flag, bit 0, bit 1, bit 2 and an odd parity are transmitted in this sequential order at predetermined intervals, for example, intervals of 20 ms. The flag is a signal indicating the leading end of sequential data and arranged to be transmitted as continuous pulse signals having a frequency of 3 kHz in the overall period of 20 ms. The bits and the parity are transmitted such that pulse sound waves having a frequency of 3 kHz are transmitted in a period of 4 ms which is an intermediate period of 20 ms when the value is "1". When the value is "0", no pulse sound wave is transmitted in the overall period of 20 ms.

Figure 14:
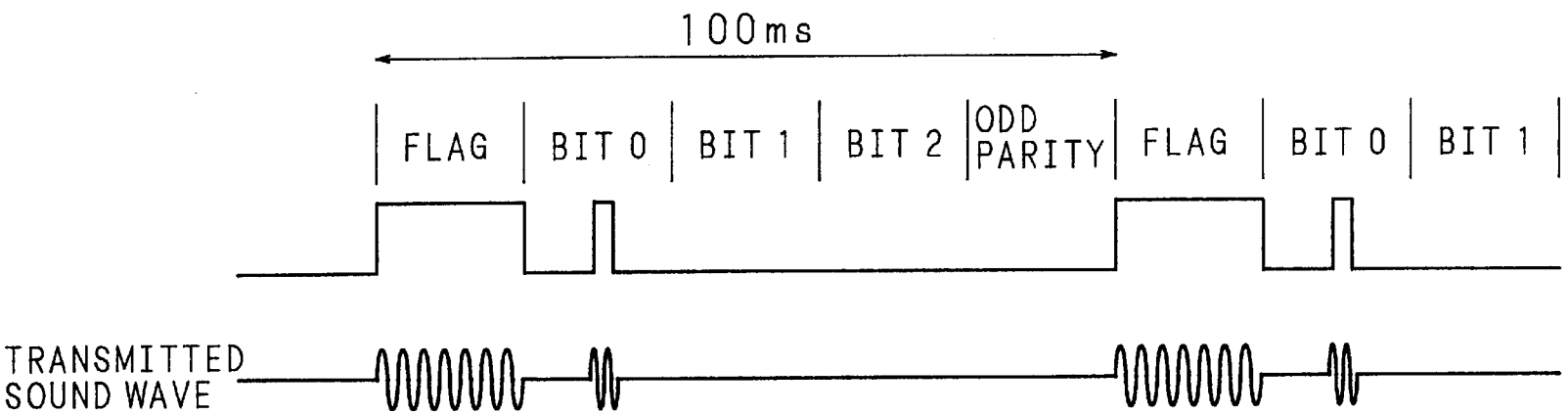
FIG. 14 is a schematic view showing a state of a signal when the values of bit 0, 1 and 2 are "1", "0" and "0" and the parity is "0" and a state of a pulse of a sound wave (an elastic wave) signal which is actually transmitted.

FIG. 14 shows an example state of a signal and a state of pulse of a sound wave (an elastic wave) signal which is actually transmitted when the values of bits 0, 1 and 2 are "1", "0" and "0" and the parity is "0". When actual transmission is performed, signals are repeatedly transmitted a predetermined number of times in the period of 100 ms.

Thus, the No. 1 train-approach-detection/forward-transmission apparatus D transmits data of the No. thereof, and then the microcomputer 16 determines whether or not the running train 2 has approached the very near location (step S13). Specifically, the foregoing determination is made in accordance with whether or not the oscillations having the frequencies in the vicinity of 5.5 kHz which is relatively to be propagated are equal to or greater than a predetermined threshold value. Since the determination is not performed that the running train 2 has reached a very near location in step S13 immediately after the approach of the running train 2 has been detected in step S11, the microcomputer 16 returns the process to step S11. Then, the microcomputer 16 repeats the processes in steps S12 and S13. Therefore, the train-approach-detection/forward-transmission apparatus D continues transmission of data of the station No. thereof until the running train 2 has approached a very near location.

When the running train 2 has approached a very near location, the approach can be detected because oscillations having frequencies in the vicinity of 5.5 kHz which are relatively difficult to be propagated becomes the predetermined value or larger (step S13). Then, the microcomputer 16 does not transmit data of the station No. thereof. The microcomputer 16 is brought to a standby state until the running train 2 passes through the location of the train-approach-detection/forward-transmission apparatus D and runs about 0.5 L (about 250 m)away from the train-approach-detection/forward-transmission apparatus D (step S14). When the running train 2 has reached a location about 0.5 L away from the train-approach-detection/forward-transmission apparatus D ("NO" in step S14), the microcomputer 16 returns the process to step S11.

When the running train 2 has approached the No. 1 train-approach-detection/forward-transmission apparatus D and passed through the same, the microcomputer 16 performs the above-mentioned process. During this, the microcomputer 16 of the No. 2 train-approach-detection/forward-transmission apparatus D performs the following process.

In a state in which the running train 2 is approaching the No. 1 train-approach-detection/forward-transmission apparatus D ("NO" in step S11), the No. 1 train-approach-detection/forward-transmission apparatus D transmits data of the station No. thereof in step S12. Although oscillations having frequencies in the vicinity of 1 kHz are small at the No. 2 train-approach-detection/forward-transmission apparatus D, the train-approach-detection/forward-transmission apparatus D receives the sound wave signal of the station No. 1 transmitted by the No. 1 train-approach-detection/forward-transmission apparatus D (step S15). Therefore, when the microcomputer 16 has normally receives the flag, bits 0, 1, 2 and the parity of the received sound wave signal, the microcomputer 16 subjects data of the received station No. to a comparison with the station No. thereof (which is 2 in this case) so as to determine whether or not the train 2 is within a predetermined range (step S16).

The "predetermined range" is a range including three train-approach-detection/forward-transmission apparatuses D disposed in a direction opposite to a direction in which the train 2 runs from the train-approach-detection/forward-transmission apparatus D. Specifically, the No. 6, No. 7 and No. 0 train-approach-detection/forward-transmission apparatuses D are included in the above-mentioned range for the No. 1 train-approach-detection/forward-transmission apparatus D. The No. 7, No. 0 and No. 1 train-approach-detection/forward-transmission apparatus D are included in the range for the No. 2 train-approach-detection/forward-transmission apparatus D. That is, if the No. 5 train-approach-detection/forward-transmission apparatus D detects the approach of the running train 2 and transmits the sound wave signal of the No. 5 train-approach-detection/forward-transmission apparatus D, the No. 1 train-approach-detection/forward-transmission apparatus D does not relay and transmit the foregoing sound wave signal ("NO" in step S16).

If data of the sound wave of the stations included in the predetermined range is received ("YES" in step S16), the microcomputer 16 of the foregoing train-approach-detection/forward-transmission apparatus D transmits data of the received station as it is as the sound wave signal (step S17). Then, the microcomputer 16 waits for a predetermined period of time (step S18), and then returns the process to step S11.

The sound wave signal on data of the station No. received in step S17 is received by three forward train-approach-detection/forward-transmission apparatuses D from the train-approach-detection/forward-transmission apparatus D in a direction in which the train 2 runs, and then transmitted to further distant train-approach-detection/forward-transmission apparatuses D. For example, the sound wave signal of data of station No. 0 transmitted from the No. 0 train-approach-detection/forward-transmission apparatus D is received by the No. 1, No. 2 and No. 3 train-approach-detection/forward-transmission apparatuses D, and then again transmitted However, the foregoing sound wave signal is not transmitted from the No. 4 train-approach-detection/forward-transmission apparatus D and the farther train-approach-detection/forward-transmission apparatuses D though the sound wave signal is received by the No. 4 and the farther train-approach-detection/forward-transmission apparatuses D.

The reason why the standby process is performed for predetermined period of time in step S18 lies in that receipt of the sound wave signal of the station No. transmitted from a next station in response to the sound wave signal of data of the station No. transmitted therefrom must be inhibited. Therefore, time required for the successive three stations to perform the processes in steps S15, S16 and S17 is the smallest value for the standby time in step S18.

The speed of the sound wave signal (the speed of sound) which is propagated through the rail 1 is about 5000 m/s. Since the foregoing speed is considerably higher than the running speed of the train 2, time required for the sound wave signal to be propagated between the train-approach-detection/forward-transmission apparatuses D does not raise a problem. Although different train-approach-detection/forward-transmission apparatuses D may sometimes transmit sound wave signals at the same time, the sound wave signal received from the train-approach-detection/forward-transmission apparatus D two stations away is usually attenuated to about 1/10 as compared with the sound wave signal received from the adjacent train-approach-detection/forward-transmission apparatus D. Therefore, only the sound wave signal transmitted from the adjacent train-approach-detection/forward-transmission apparatus D is clearly received.

In a state in which the running train 2 approaches, for example, the No. 1 train-approach-detection/forward-transmission apparatus D, the sound wave signal indicating the station No. 1 transmitted from the No. 1 train-approach-detection/forward-transmission apparatus D is transmitted to the No. 4 train-approach-detection/forward-transmission apparatus D without exception.

Figure 13:
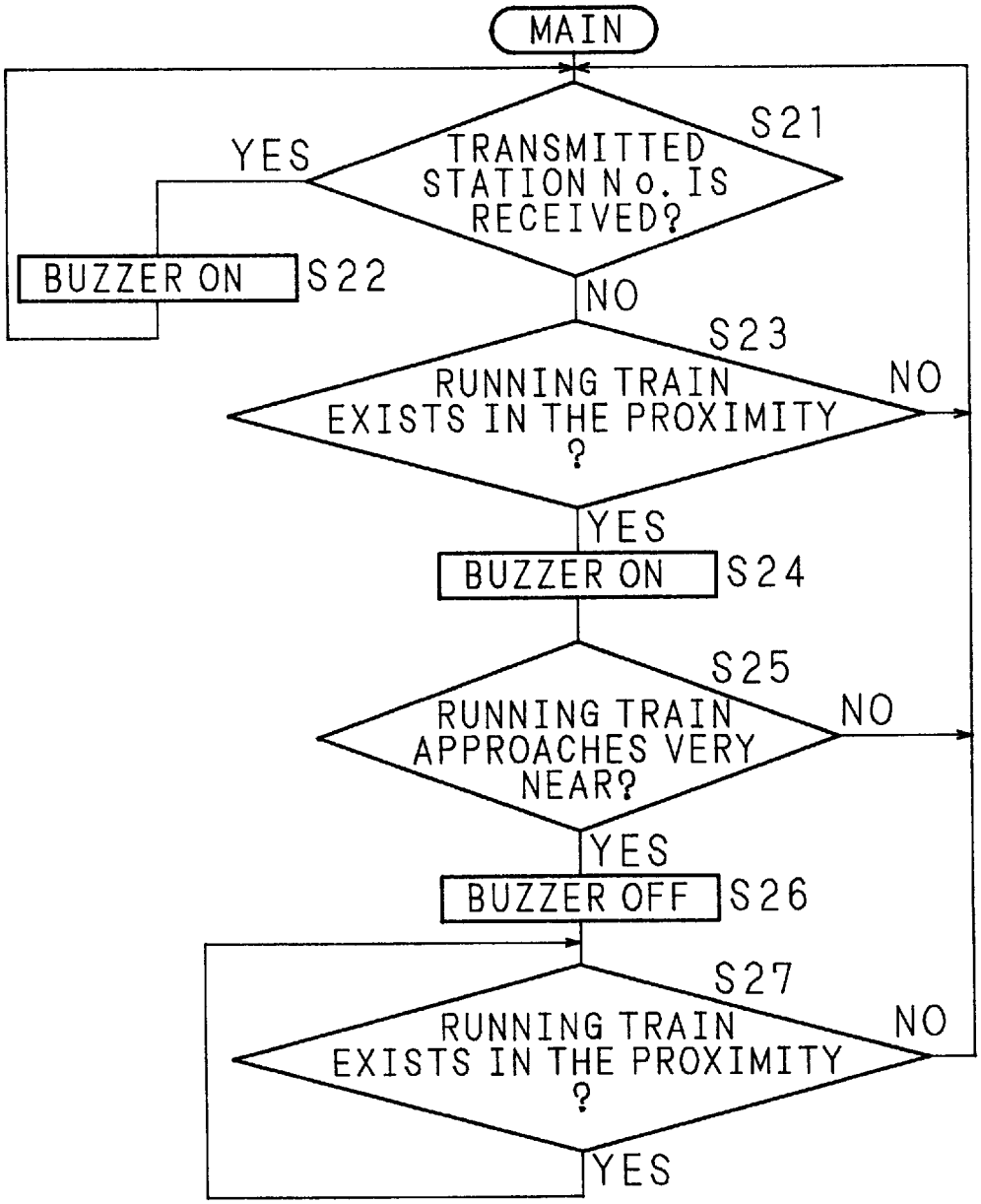
FIG. 13 is a flow chart showing a process of control which is performed by a microcomputer of a train-approach-alarm generating apparatus according to the first embodiment.

The train-approach-alarm generating apparatuses H1 and H2 are operated by the microcomputer 16 as shown in a flow chart shown in FIG. 13.

An assumption is made that the train-approach-alarm generating apparatus H1 is connected to the rail 1 at a location between the No. 3 train-approach-detection/forward-transmission apparatus D and the No. 4 train-approach-detection/forward-transmission apparatus D as shown in FIG. 9. If the running train 2 approaches the No. 1 train-approach-detection/forward-transmission apparatus D, the sound wave signal indicating the station No. 1 transmitted from the No. 1 train-approach-detection/forward-transmission apparatus D is received by the No. 3 train-approach-detection/forward-transmission apparatus D. At the moment when the foregoing sound wave signal is again transmitted from the No. 3 train-approach-detection/forward-transmission apparatus D, the sound wave signal is received by the train-approach-alarm generating apparatus H1 ("YES" in step S21).

That is, when the running train 2 has reached the location which is the total distance (2.5L+L1) of distance L/2 which is the train detection distance for the No. 1 train-approach-detection/forward-transmission apparatus D, the distance 2L between the No. 1 train-approach-detection/forward-transmission apparatus D and the No. 3 train-approach-detection/forward-transmission apparatus D and the distance L1 between the No. 3 train-approach-detection/forward-transmission apparatus D and the train-approach-alarm generating apparatus H1, the train-approach-alarm generating apparatus H1 receives the sound wave signal indicating the station No. 1 which is relayed and transmitted from the station No. 3. Then, the buzzer 19 is turned on (generates an alarm) (step S22) so that the approach of the train 2 is communicated to the operator.

The train 2 may sometimes approach the train-approach-alarm generating apparatus H1 without receipt of data of the foregoing station No. In this case ("NO" in step S21 and "YES" in step Side), the microcomputer 16 of the train-approach-alarm generating apparatus H1 turns the buzzer 19 on (step S24).

In the foregoing cases, when the running train 2 has approached a very near location ("YES" in step S25), the microcomputer 16 of the train-approach-alarm generating apparatus H1 detects oscillations having the frequencies in the vicinity of 5.5 kHz so as to interrupt the operation of the buzzer 19 (step S26). After the train 2 has traveled away from the position of the train-approach-alarm generating apparatus H1 to a certain distance, the microcomputer 16 interrupts the process ("NO" in step S27). Then, the microcomputer 16 returns the process to step S21.

Also in the train-approach-alarm generating apparatus H2 connected to the rail 1 at a position between the No. 4 train-approach-detection/forward-transmission apparatus D and the No. 5 train-approach-detection/forward-transmission apparatus D, the buzzer 19 is turned on at the moment when the running train 2 has approached the No. 2 train-approach-detection/forward-transmission apparatus D.

Second Embodiment

Figure 15:
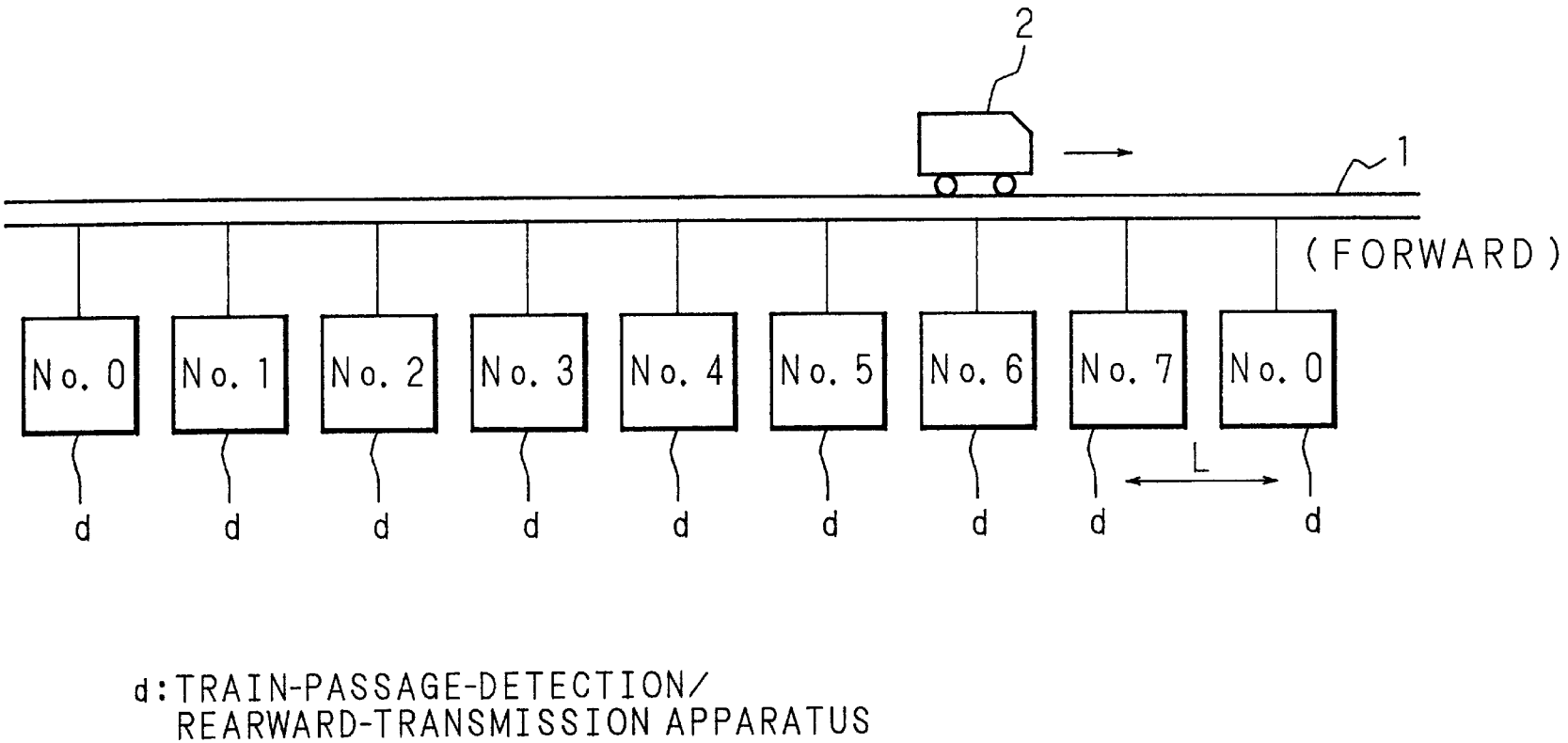
FIG. 15 is a schematic view showing an example of the overall structure of a second embodiment of the train-location detection system according to the present invention.
Figure 16:
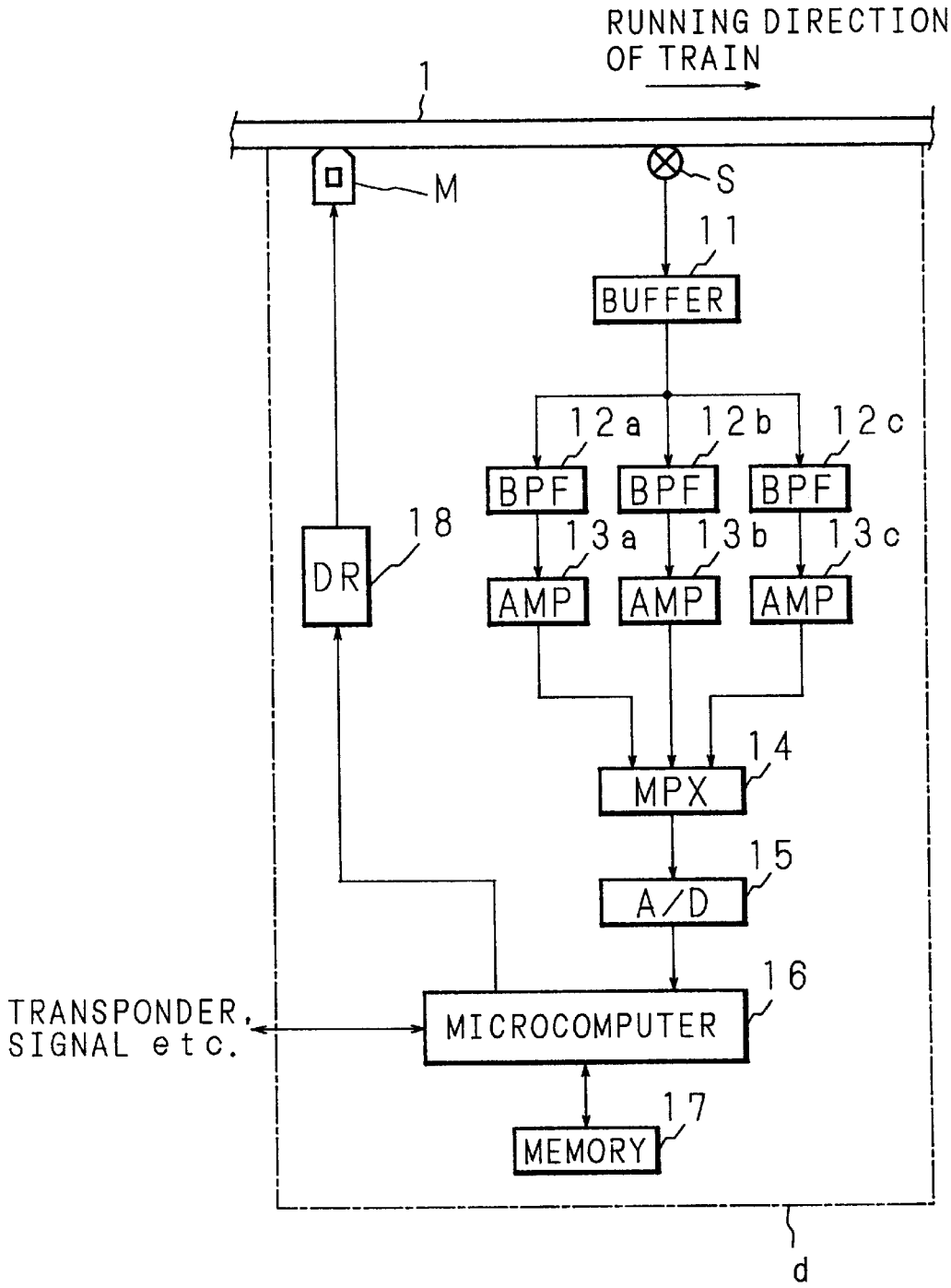
FIG. 16 is a block diagram showing an example of the structure of each train detection apparatus of the second embodiment of the train-location detection system according to the present invention.

A second embodiment will now be described in which the train detection apparatus and the train-location detection system according to the present invention is applied to a train signal securing control will now be described with reference to a schematic view shown in FIG. 15. Referring to FIG. 15, symbol d represents a train-passage-detection/rearward-transmission apparatus which is the train detection apparatus according to the present invention. The train-passage-detection/rearward-transmission apparatus d has a similar structure to that of the train-approach-detection/forward-transmission apparatus D in terms of the hardware. As shown in FIG. 16 which is a block diagram, the train passage-detection/rearward-transmission apparatus d incorporates the microcomputer 16 which has an interface with transponders and signal units which are provided for the usual railway.

The train signal security control is performed so that the signal unit is switched in accordance with the distance from the preceding train or the foregoing distance is communicated to the following train by using the transponder or the like so that the safety operation is performed.

The operations of the stations which are performed when the running train 2 approaches, for example, a No. 6 train-passage-detection/rearward-transmission apparatus d and passes through the same as shown in FIG. 15 will now be described with reference to a flow chart shown in FIG. 17 which shows the process of control which is performed by the microcomputer 16.

When the running train 2 approaches the No. 6 train-passage-detection/rearward-transmission apparatus d, oscillations having frequencies in the vicinity of 1 kHz gradually grew larger ("NO" in steps S31 and S32). When the train 2 has furthermore approached, oscillations having frequencies in the vicinity of 5.5 kHz continuously exceed the threshold value ("YES" in step S32 and "YES" in step S33). After the running train 2 has passed through, the oscillations rapidly reduce ("NO" in step S33). Therefore, the microcomputer 16 of the train-passage-detection/rearward-transmission apparatus d is able to detect the passage of the running train 2 immediately after the train 2 has passed through in step S33. In consequence, the microcomputer 16 transmits data of the station No. thereof (step S34), and then updates data of the train 2, specifically performs update to "6" (step S35).

When the running train 2 has traveled to a furthermore distant location, the oscillations having the frequencies in the vicinity of 5.5 kHz gradually reduce. However, the oscillations having the frequencies in the vicinity of 1 kHz are still equal to or larger than the predetermined threshold value ("YES" in step S36). Therefore, the microcomputer 16 repeats the processes in steps S33 to S35. When the running train 2 has traveled to a furthermore distant location, also the oscillations having the frequencies in the vicinity of 1 kHz gradually reduce ("NO" in step S36). Therefore, the microcomputer 16 returns the process to step S31.

Since the train 2 has passed through the No. 5 train-passage-detection/rearward-transmission apparatus d, the oscillations having the frequency in the vicinity of 1 kHz are small. Therefore, the No. 5 train-passage-detection/rearward-transmission apparatus d receives data of the station No. transmitted from the No. 6 train-passage-detection/rearward-transmission apparatus d in the form of the sound wave signal ("YES" in step S31). If the received station No. is a station No. included in a predetermined range to be described later ("YES" in step S37), the No. 5 train-passage-detection/rearward-transmission apparatus d transmits data of the station No. thereof to the No. 4 train-passage-detection/rearward-transmission apparatus d (step S38). Then, the No. 5 train-passage-detection/rearward-transmission apparatus d updates data of the train 2 to "6" which is data of the received station No. (step S39). Then, standby is performed in step S40 for a predetermined period of time similarly to the first embodiment.

The "predetermined" range in step S37 will now be described In the second embodiment, four rearward train-passage-detection/rearward-transmission apparatuses d in the direction of travel of the running train 2 relay data of the station No. For example, the No. 1 train-passage-detection/rearward-transmission apparatus d transmits data to the No. 0, No. 7, No. 6 and No. 5 train-passage-detection/rearward-transmission apparatuses d The No. 4 train-passage-detection/rearward-transmission apparatus d transmits data to the No. 3, No. 2, No. 1 and No. 0 train-passage-detection/rearward-transmission apparatuses d.

When data of the station No. 6 has been transmitted from the No. 6 train-passage-detection/rearward-transmission apparatus d, No. 2 to No. 5 train-passage-detection/rearward-transmission apparatuses d receive data above and immediately transmit the station No. The No. 2 to No. 5 train-passage-detection/rearward-transmission apparatuses d receive data of the station No. 6 transmitted from the No. 6 train-passage-detection/rearward-transmission apparatus d so that a fact that the running train 2 has passed through the No. 6 train-passage-detection/rearward-transmission apparatus d and approaches the No. 7 train-approach-detection/forward-transmission apparatus D is detected On the other hand, the No. 1 train-passage-detection/rearward-transmission apparatus d has "5" as data of the train 2 which is data of the preceding station by one. Therefore, a fact can be detected that the train 2 is running forwards beyond the No. 5 train-passage-detection/rearward-transmission apparatus d.

When the running train 2 has passed through the No. 7 train-passage-detection/rearward-transmission apparatus d, data of the train 2 is updated to "7" in the No. 7 train-passage-detection/rearward-transmission apparatus d and No. 6 to No. 3 train-passage-detection/rearward-transmission apparatuses d similarly to the above-mentioned process. Since the distances among the stations are known, the signals are switched in accordance with the distances. The distances are transmitted by the transponders or the like so that the train 2 is braked or the like. Thus, safety of the train signal can be controlled

Third Embodiment

A third embodiment will now be described in which a track circuit which is the most usual train detection method for usual railways is combined with the train detection apparatus and the train-location detection system according to the present invention.

The track circuit is a technology in which rails are insulated from each other at an arbitrary distance. Moreover, predetermined voltage is always applied to the right and left rails through a resistor. When a train has reached rails 1, the resistance between the rails 1 is made to be substantially zero. By using the foregoing fact, existence of a train is detected Therefore, the track circuit method must have a structure that the rails 1 are electrically insulated from each other at an arbitrary position.

Figure 18:
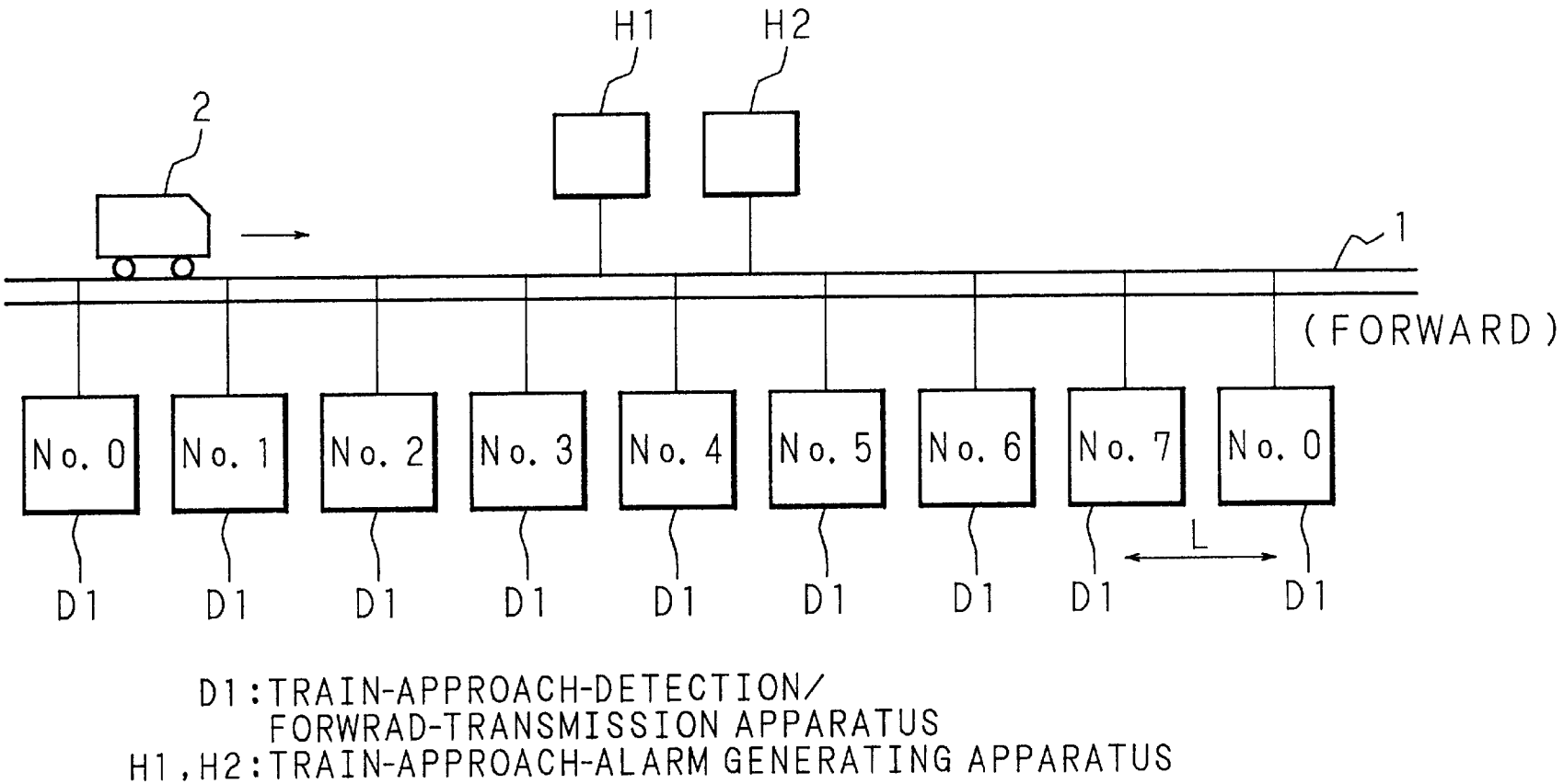
FIG. 18 is a schematic view showing an example of the overall structure of a third embodiment of the train-location detection system according to the present invention.
Figure 19:
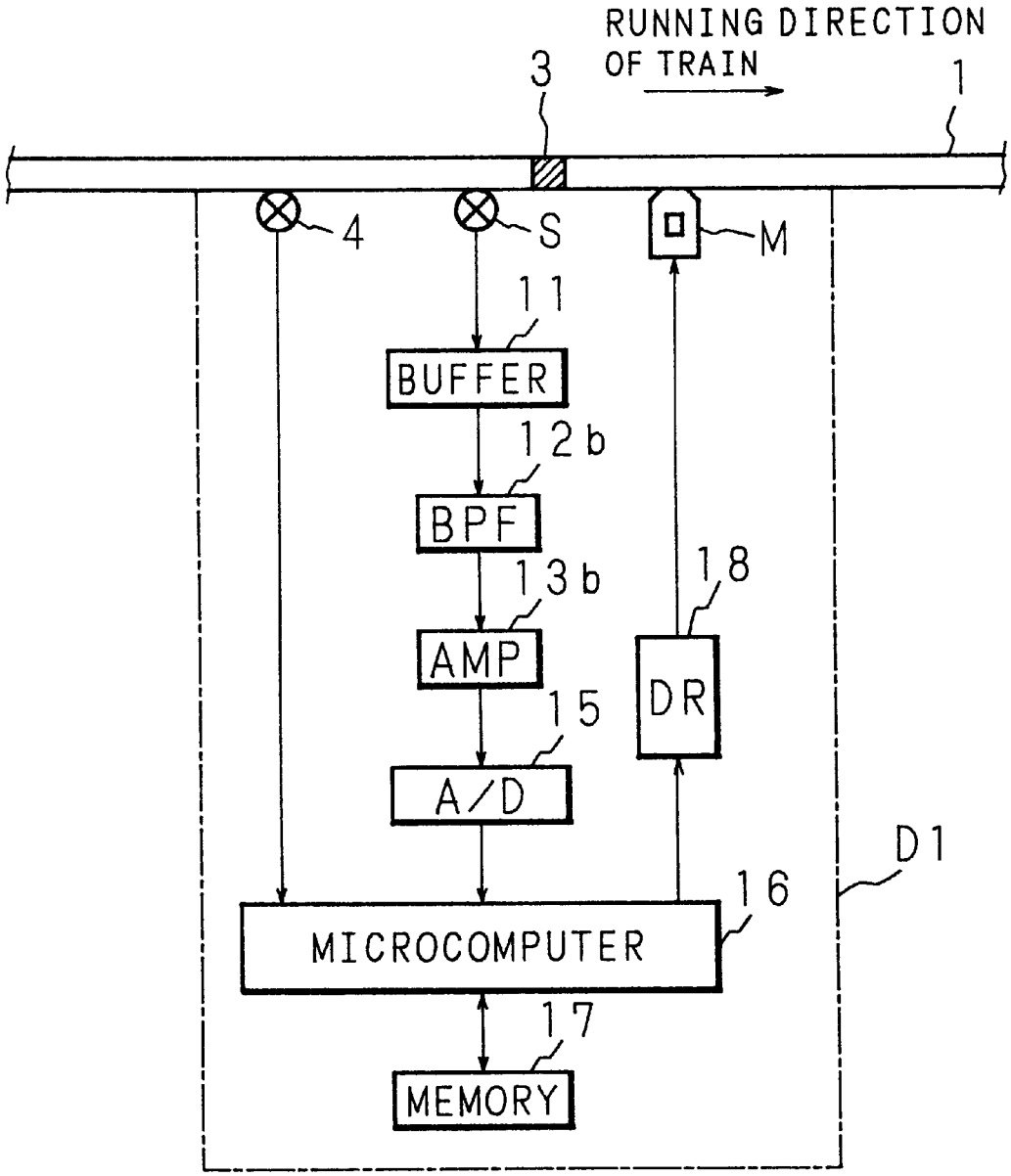
FIG. 19 is a block diagram showing an example of the structure of each train detection apparatus of the third embodiment of the train-location detection system according to the present invention.

As shown in FIG. 18 which is a schematic view, an assumption is made that a train-approach-detection/forward-transmission apparatus D1 is disposed in an insulating portion between the rails 1. The detailed structure of the train-approach-detection/forward-transmission apparatus D1 is shown in FIG. 19 which is a block diagram Note that reference numeral 4 shown in FIG. 19 represents a track circuit sensor for detecting a change in the impedance (change in the voltage) between the rails 1. Reference numeral 3 represents a rail insulating portion. The track circuit sensor 4 and the acceleration sensor S are provided for a portion of the rail 1 at positions behind the rail insulating portion 3 in a direction in which the train 2 runs. The magnetostrictive oscillator M is provided for the rail 1 at a position more ahead of the rail insulating portion 3.

The third embodiment has a structure that the train is detected by the track circuit. Therefore, only band pass filter 12*b* shown in FIG. 10 is provided which permits passage of frequencies in the vicinity of 3 kHz which is most easy to be propagated among signal-transmitting sound waves (elastic waves) generated by the magnetostrictive oscillator M. Therefore, also only one amplifier 13*b* is provided. The other basic structures are the same as those shown in FIG. 10.

Figure 20:
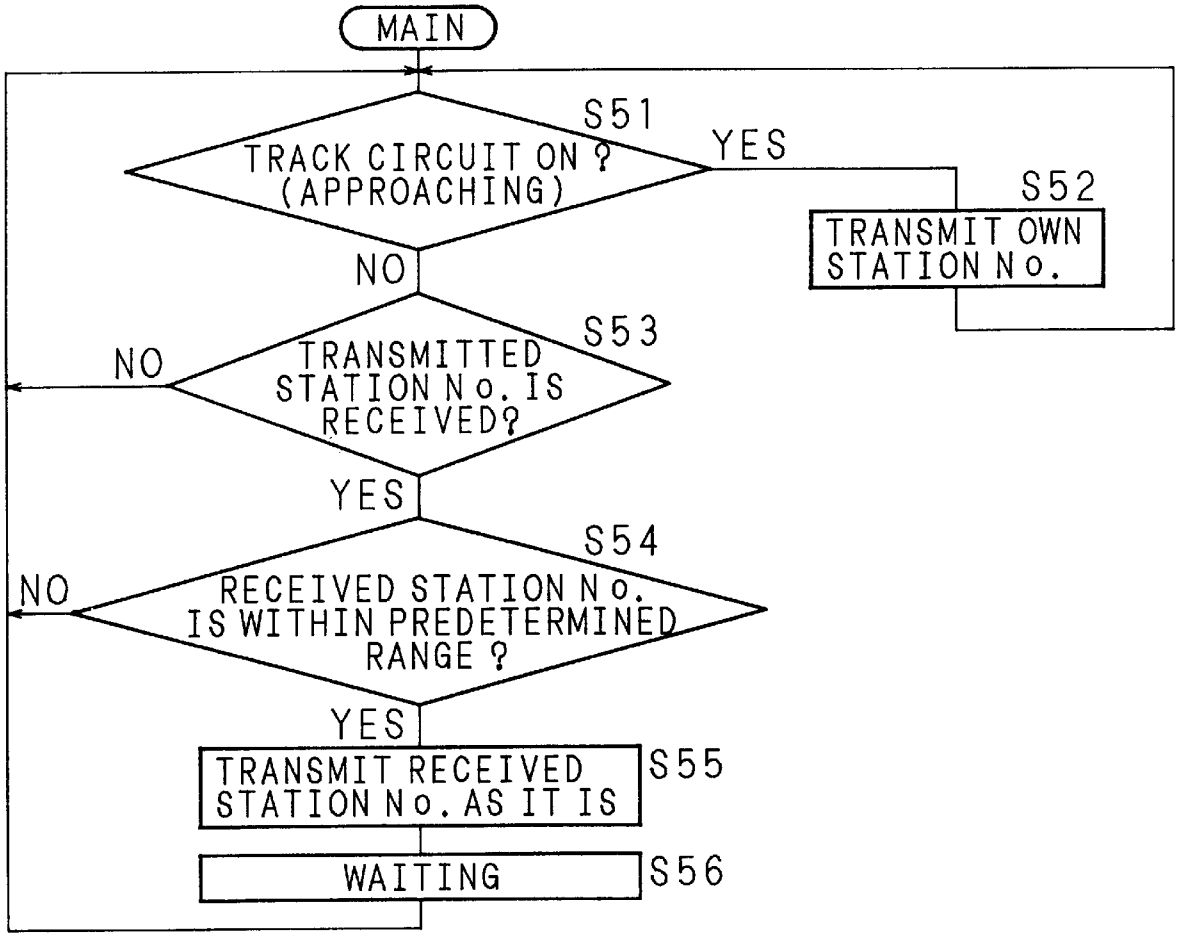
FIG. 20 is a flow chart of a process of control which is performed by a microcomputer of a train detection apparatus of a third embodiment of the train-location detection system according to the present invention.

A flow chart of a control process which is performed by the microcomputer 16 of the train-approach-detection/forward-transmission apparatus D1 according to the third embodiment is shown in FIG. 20. A state will now be described in which the train 2 is approaching a No. 1 train-approach-detection/forward-transmission apparatus D1.

If no train 2 exists on the rails 1, voltage of a certain level is applied between the rails 1. If the train 2 exists, the impedance between the rails 1 becomes substantially zero. Therefore, the voltage between the rails 1 becomes substantially zero. The foregoing state is called a "on-state" for the track circuit. When the train 2 is approaching the station No. 1, the No. 1 train-approach-detection/forward-transmission apparatus D1 detects the on-state of the track circuit ("YES" in step S51). In the foregoing case, the microcomputer 16 of the No. 1 train-approach-detection/forward-transmission apparatus D1 causes the magnetostrictive oscillator M to transmit data of the No. 1 train-approach-detection/forward-transmission apparatus D1 (step S52).

At this time, the No. 2 and No. 3 train-approach-detection/forward-transmission apparatuses D1 receive data of the station No. 1 to transmit data of the station No. by the bucket-brigade method similarly to the first embodiment. Processes in steps S53 to S56 shown in FIG. 20 are similar to those in steps S15 to S18 according to the first embodiment which is shown in FIG. 12.

The hardware structures and the operations of the train-approach-alarm generating apparatuses H1 and H2 are the same as those according to the first embodiment. The train-approach-alarm generating apparatus H1 is controlled by the microcomputer 16 in such a manner that the buzzer 19 sounds at the moment when the running train 2 reaches the rails 1 between the No. 0 train-approach-detection/forward-transmission apparatus D1 and the No. 1 train-approach-detection/forward-transmission apparatus D1 because the No. 1 train-approach-detection/forward-transmission apparatus D1 detects the state of the track circuit at the foregoing moment in time.

Fourth Embodiment

Figure 21:
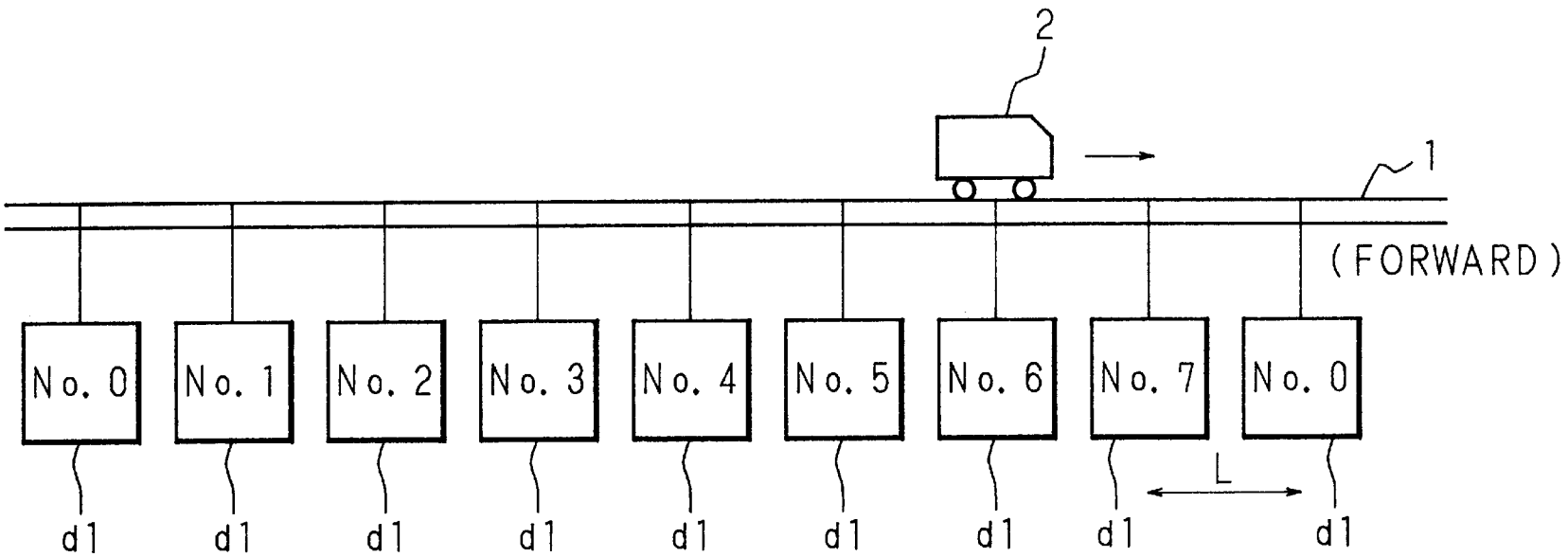
FIG. 21 is a schematic view showing an example of the overall structure of a fourth embodiment of the train-location detection system according to the present invention.

An example of train signal security control constituted by combining the track circuit and the train detection apparatus and the train-location detection system according to the present invention will now be described with reference to FIG. 21 which is a schematic view. The train-passage-detection/rearward-transmission apparatus d1 is disposed in the rail insulating portion 3 of the rail 1 similarly to the third embodiment.

Figure 22:
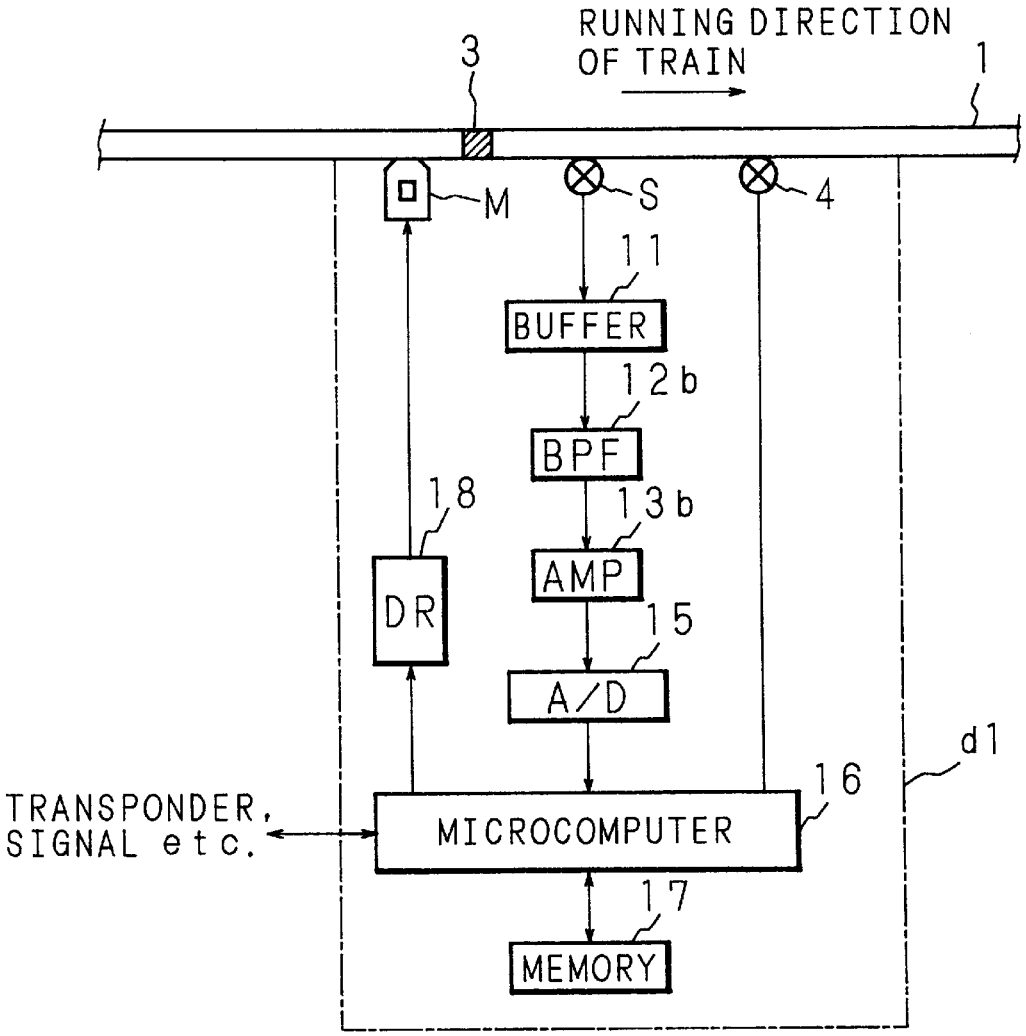
FIG. 22 is a block diagram showing an example of the structure of each train detection apparatus of the fourth embodiment of the train-location detection system according to the present invention.

FIG. 22 is a block diagram showing an example of a detailed structure of the train-passage-detection/rearward-transmission apparatus d1. The basic structure is the same as that according to the third embodiment shown in FIG. 19. The difference lies in that the track circuit sensor 4 and the acceleration sensor S are disposed ahead of the rail insulating portion 3 in a direction in which the train 2 runs. Moreover, the magnetostrictive oscillator M is disposed behind the rail insulating portion 3. Similarly to the second embodiment shown in FIG. 16 which is a block diagram the microcomputer 16 has an interface with transponders and signal units which are employed in a usual railway.

The operation of the train-passage-detection/rearward-transmission apparatus d1 according to the fourth embodiment will now be described with reference to a flow chart of the control process shown in FIG. 23 and arranged to be performed by the microcomputer 16.

An assumption is made that a running train 2 is passing through a No. 6 train-passage-detection/rearward-transmission apparatus d1. In this state, the No. 6 train-passage-detection/rearward-transmission apparatus d1 detects a state of the track circuit after the leading end of the running train 2 has passed through ("NO" in step S61 and "YES" in step S62). Then, the No. 6 train-passage-detection/rearward-transmission apparatus d1 transmits data of the No. 6 train-passage-detection/rearward-transmission apparatus d1 as a sound wave signal (step S63), and then updates data of the train to "6" (step S64).

The operations of the No. 2 to No. 5 train-passage-detection/rearward-transmission apparatuses d1 are similar to those according to the second embodiment. Data of the station No. is transmitted by the bucket-brigade method using the sound wave signal. Specifically, processes in step S65 to S68 shown in FIG. 23 are similar to those in steps S37 to S40 according to the first embodiment shown in FIG. 17.

Since the train-passage-detection/rearward-transmission apparatuses d1 according to the fourth embodiment are able to detect the distance to the preceding train as described above, the foregoing structure can be used to perform train signal security control.

Fifth Embodiment

Figure 24:
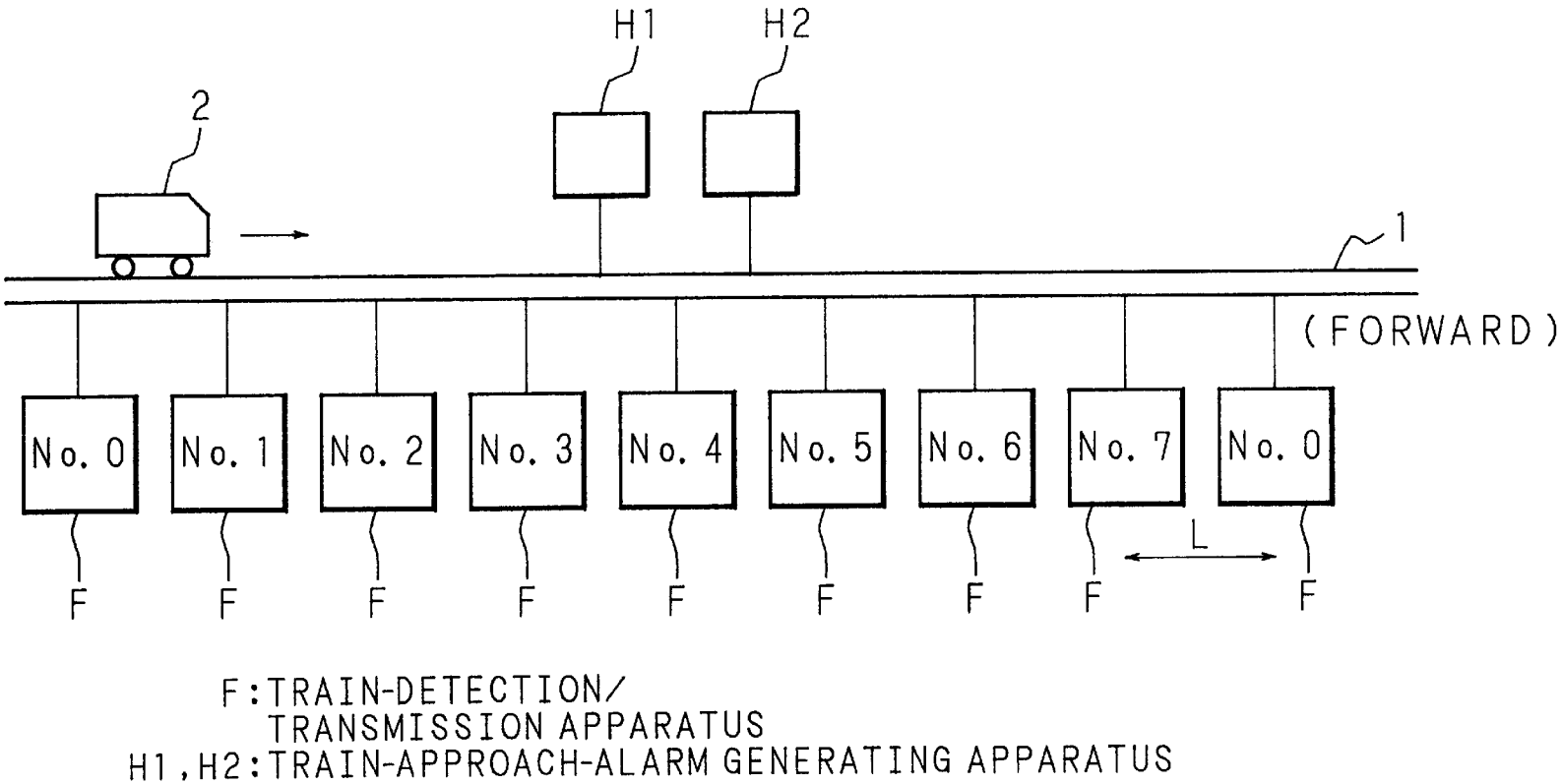
FIG. 24 is a schematic view showing an example of the overall structure of a fifth embodiment of the train-location detection system according to the present invention.

A fifth embodiment will now be described in which train-detection/transmission apparatuses F each having both of the functions of the train-approach-detection/forward-transmission apparatus and the train-passage-detection/rearward-transmission apparatus are disposed at substantially predetermined intervals and which is shown in FIG. 24 which is a schematic view and FIG. 25 which is a block diagram showing the detailed structure.

Figure 25:
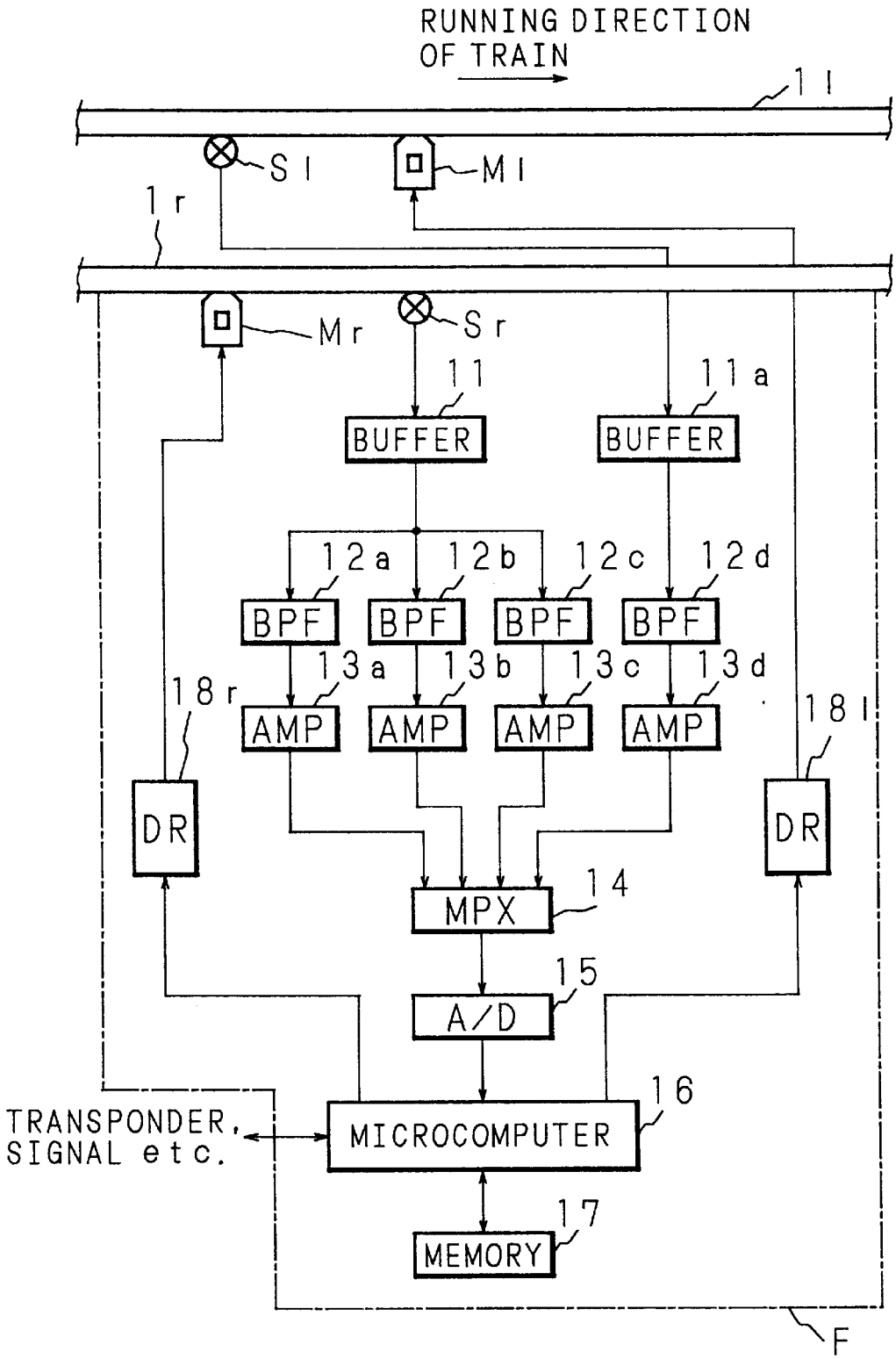
FIG. 25 is a block diagram showing an example of the structure of each train detection apparatus of the fifth embodiment of the train-location detection system according to the present invention.

Referring to FIG. 25, reference numerals S1 and M1 represent an acceleration sensor and a magnetostrictive oscillator provided for the left-hand rail 11 in a direction in which the train 2 runs. Symbols Sr and Mr represent an acceleration sensor and a magnetostrictive oscillator provided for the right-hand rail 1r in a direction in which the train 2 runs. Note that the acceleration sensor S1 and Sr and the magnetostrictive oscillators M1 and Mr have functions of the corresponding acceleration sensor S and the magnetostrictive oscillator M described in the foregoing embodiments.

The acceleration sensor S1 and the magnetostrictive oscillator M1 realize the function for train-approach-detection/forward-transmission, while the acceleration sensor Sr and the magnetostrictive oscillator Mr realize the function for train-passage-detection/rearward-transmission Reference numeral 11*a* represents a buffer having the same function as that of the buffer amplifier 11 shown in FIG. 10. Reference numeral 12*d* represents a narrow band pass filter for permitting passage of frequencies in the vicinity of 3 kHz similarly to the band pass filter 12*b* shown in FIG. 10. Reference numeral 13*d* represents an amplifier similar to the amplifier (AMP) 13*b* shown in FIG. 10. Reference numerals 181 and 18*r* show drivers for applying an electric current to each of the magnetostrictive oscillators M1 and Mr similarly to the driver 18 shown in FIG. 10 so as to operate the magnetostrictive oscillators M1 and Mr.

Reference numerals H1 and H2 represent train-approach-alarm generating apparatuses having the same structures, functions and operations as those shown in FIG. 11.

Figure 17:
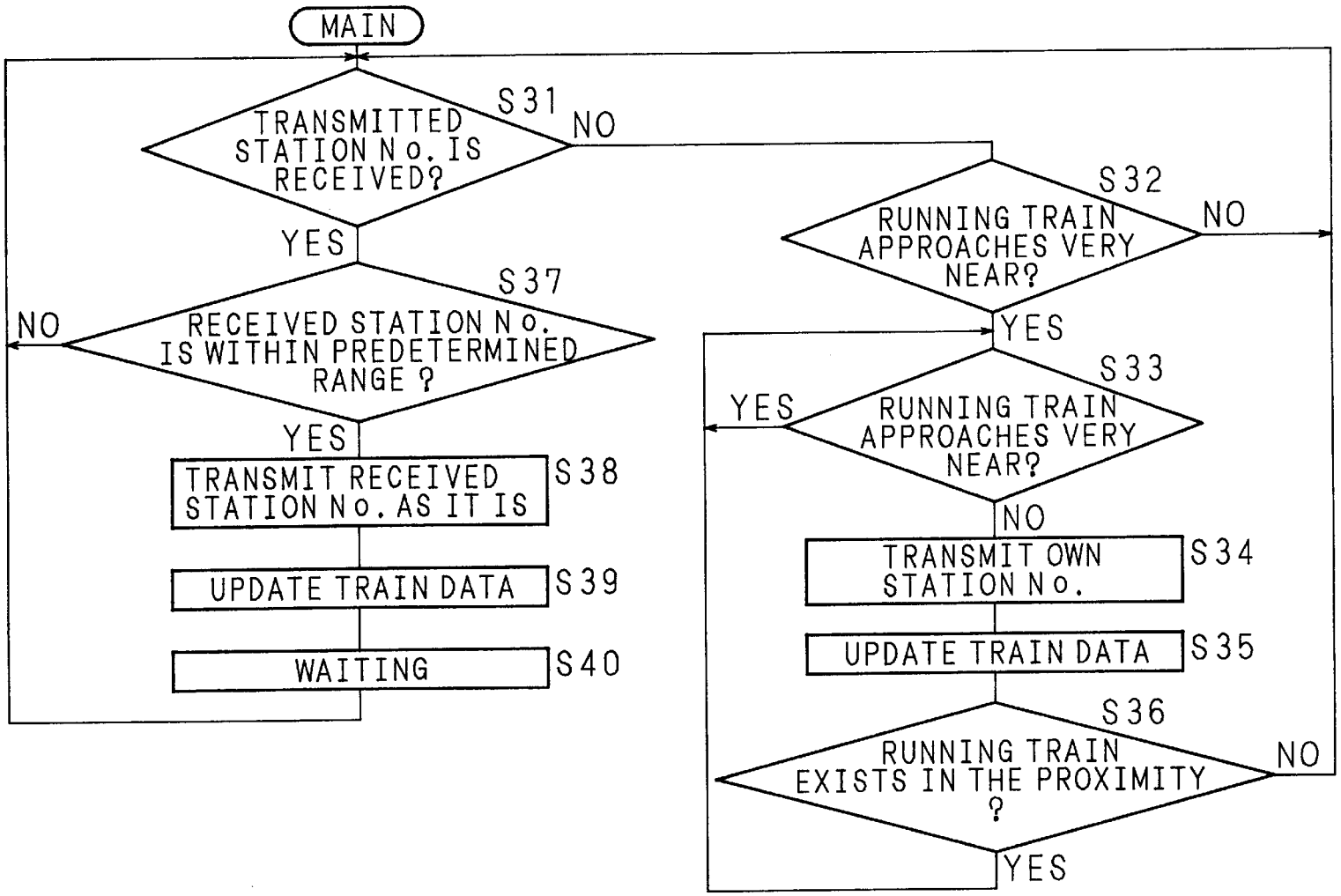
FIG. 17 is a flow chart showing a process of control which is performed by a microcomputer of a train detection apparatus of the second embodiment of the train-location detection system according to the present invention.

The train-detection/transmission apparatus F having the above-mentioned structure and incorporating one microcomputer 16 is able to execute the control procedure shown in the flow chart according to the first embodiment shown in FIG. 12 and the flow chart according to the second embodiment shown in FIG. 17. Therefore, an apparatus having the two functions can be realized. Therefore, the cost of the apparatus can be reduced as compared with a structure in which the two types of the apparatuses are provided. In addition, labor and cost for installing the apparatuses can be reduced.

Sixth Embodiment

Figure 26:
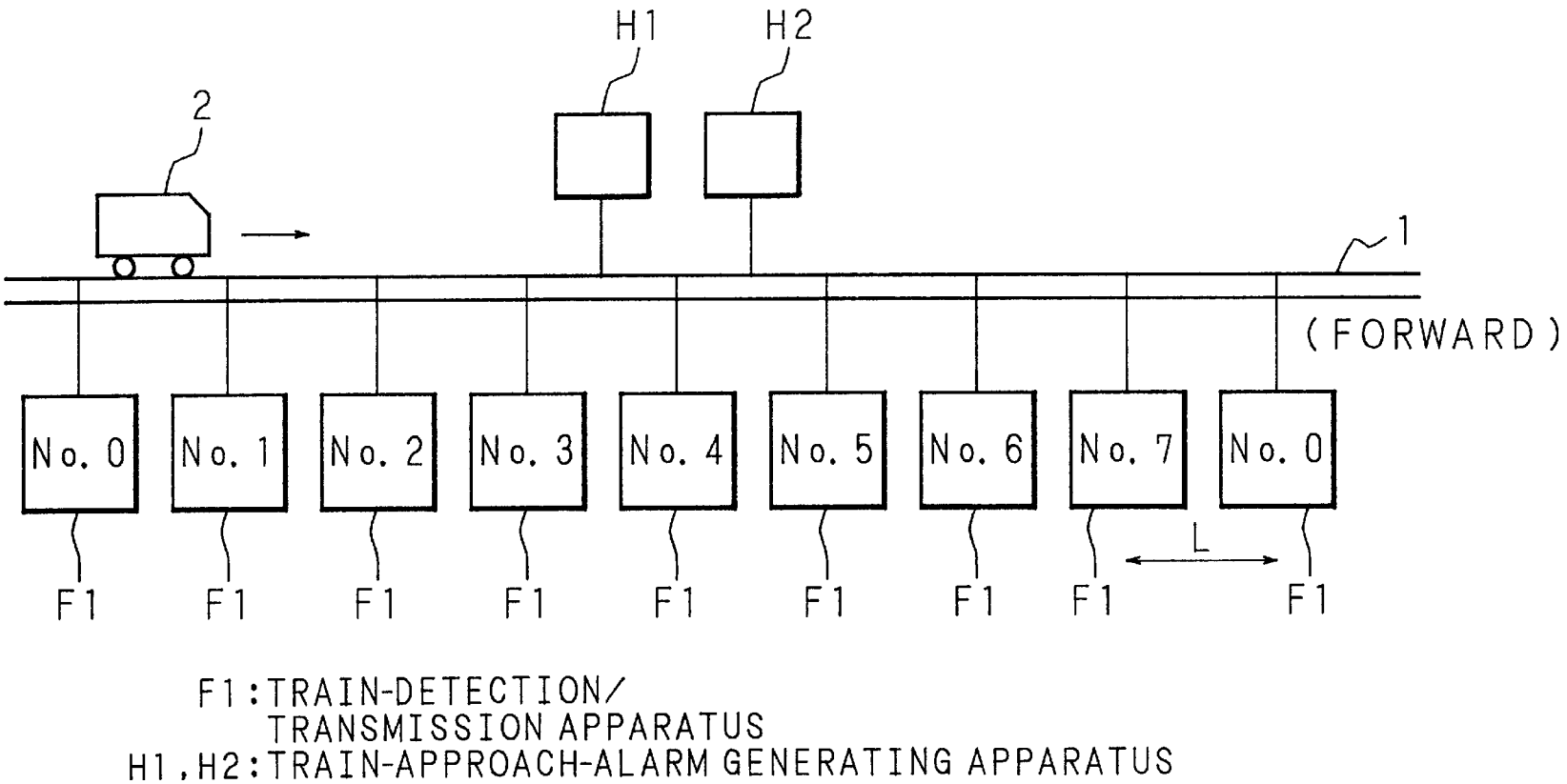
FIG. 26 is a schematic view showing an example of the overall structure of a sixth embodiment of the train-location detection system according to the present invention.

A sixth embodiment will now be described which incorporates the train-detection/transmission apparatuses F1 each using the track circuit and having the functions of the train-approach-detection/forward-transmission apparatus and the train-passage-detection/rearward-transmission apparatus. The description is made with reference to FIG. 26 which is a schematic view showing a state in which the train-detection/transmission apparatuses F1 are disposed at substantially the same intervals and FIG. 27 which is a block diagram showing the detailed structure.

Figure 27:
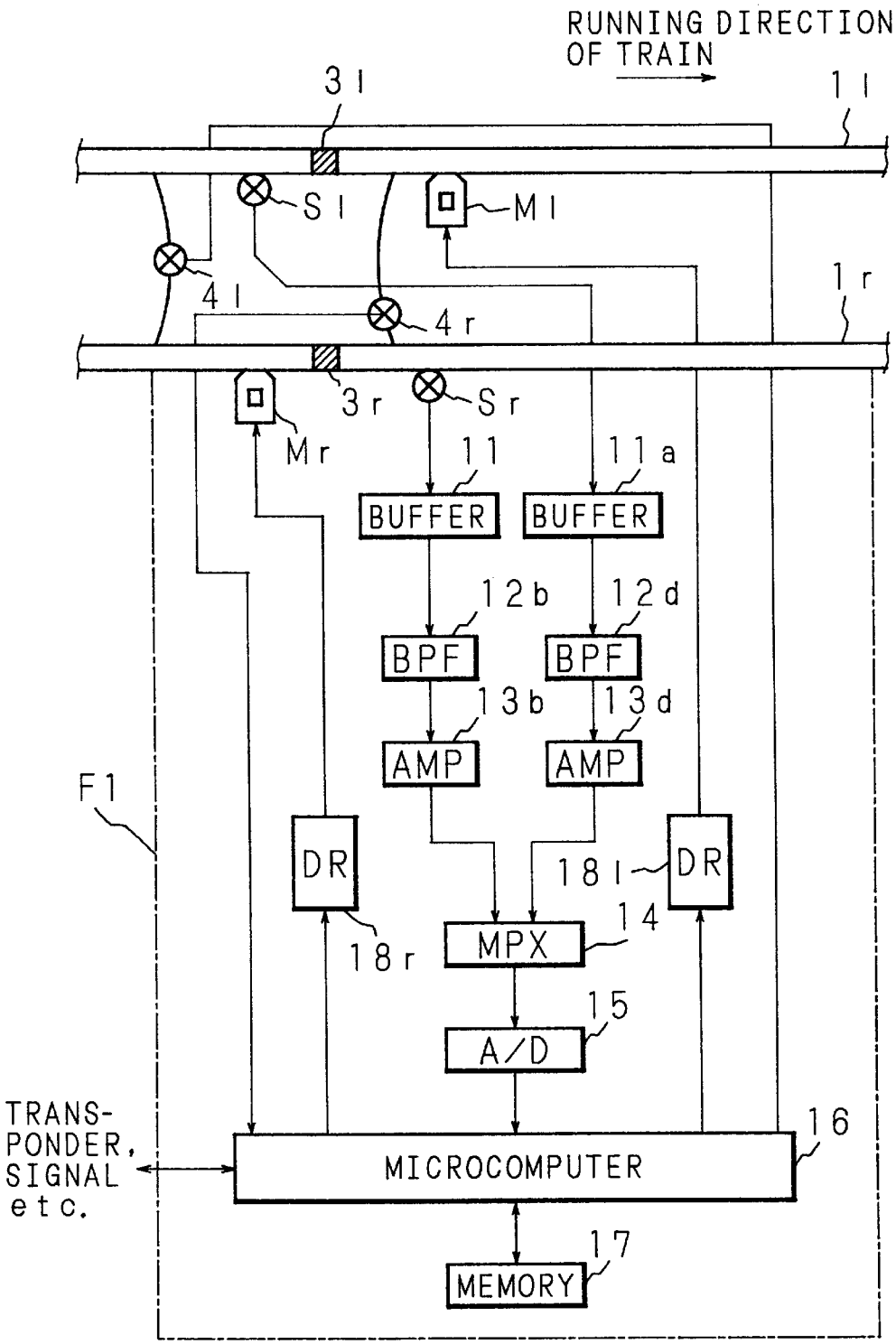
FIG. 27 is block diagram showing an example of the structure of each train detection apparatus of the sixth embodiment of the train-location detection system according to the present invention.

Referring to FIG. 27, reference numerals 41and 4*r* represent track circuit sensors 4 for detecting approach and passage of the train The track circuit sensors 41 and 4*r* are similar to those according to the third embodiment shown in FIG. 19. Reference numerals H1 and H2 represent train-approach-alarm generating apparatuses having the same structures, functions and operations as those of the train-approach-alarm generating apparatuses shown in FIG. 11.

Figure 23:
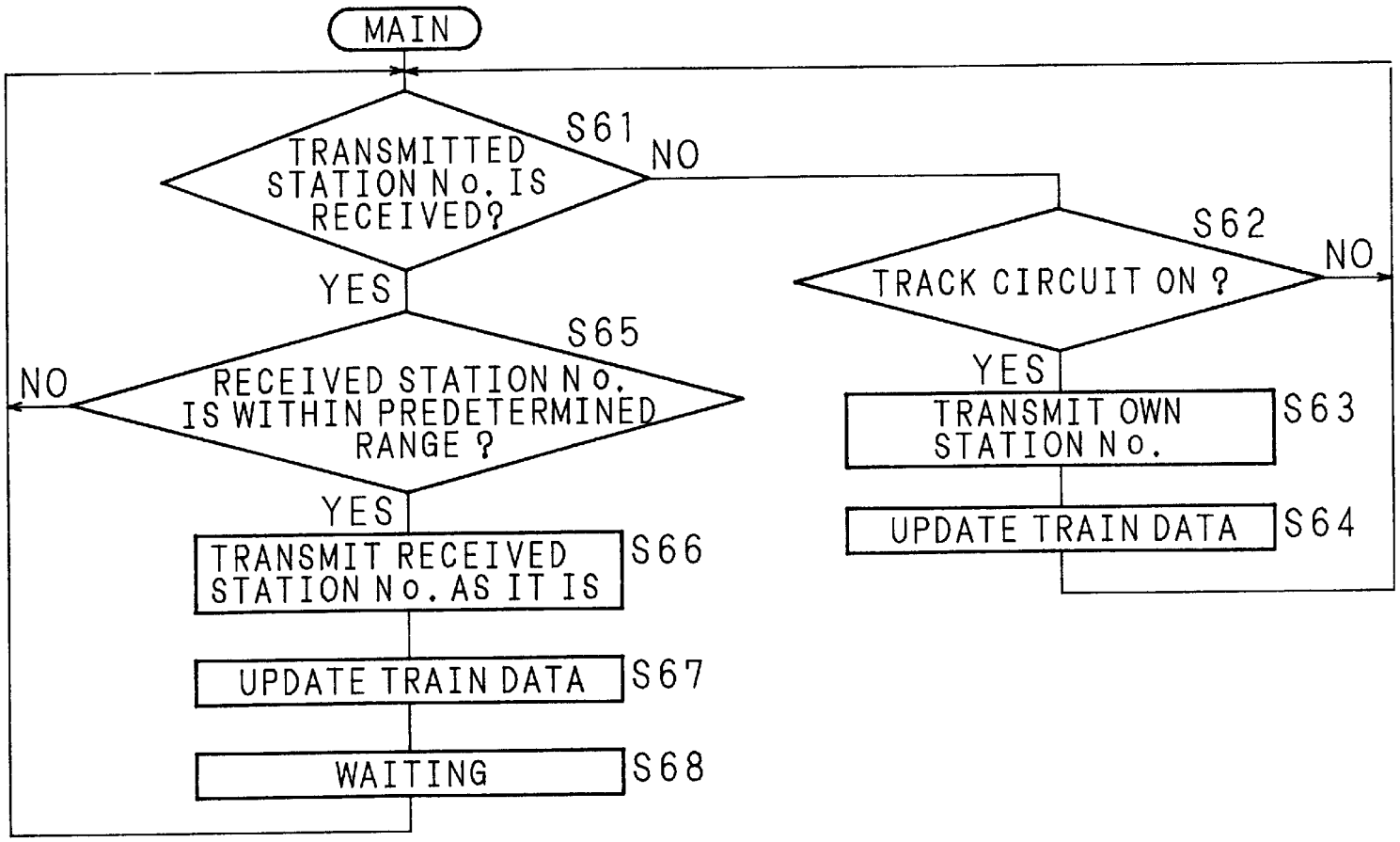
FIG. 23 is a flow chart showing a procedure of control which is performed by a microcomputer of the train detection apparatus according to the fourth embodiment of the train-location detection system according to the present invention.

When the above-mentioned structure is employed, one microcomputer 16 is able to perform the control processes shown in the flow chart according to the third embodiment shown in FIG. 20 and the flow chart according to the fourth embodiment shown in FIG. 23. Therefore, an apparatus having the two functions can be realized. Therefore, the cost of the apparatus can be reduced as compared with a structure having the two types of the apparatuses. Moreover, labor and cost required to install the apparatus can be reduced.

Seventh Embodiment

Figure 28:
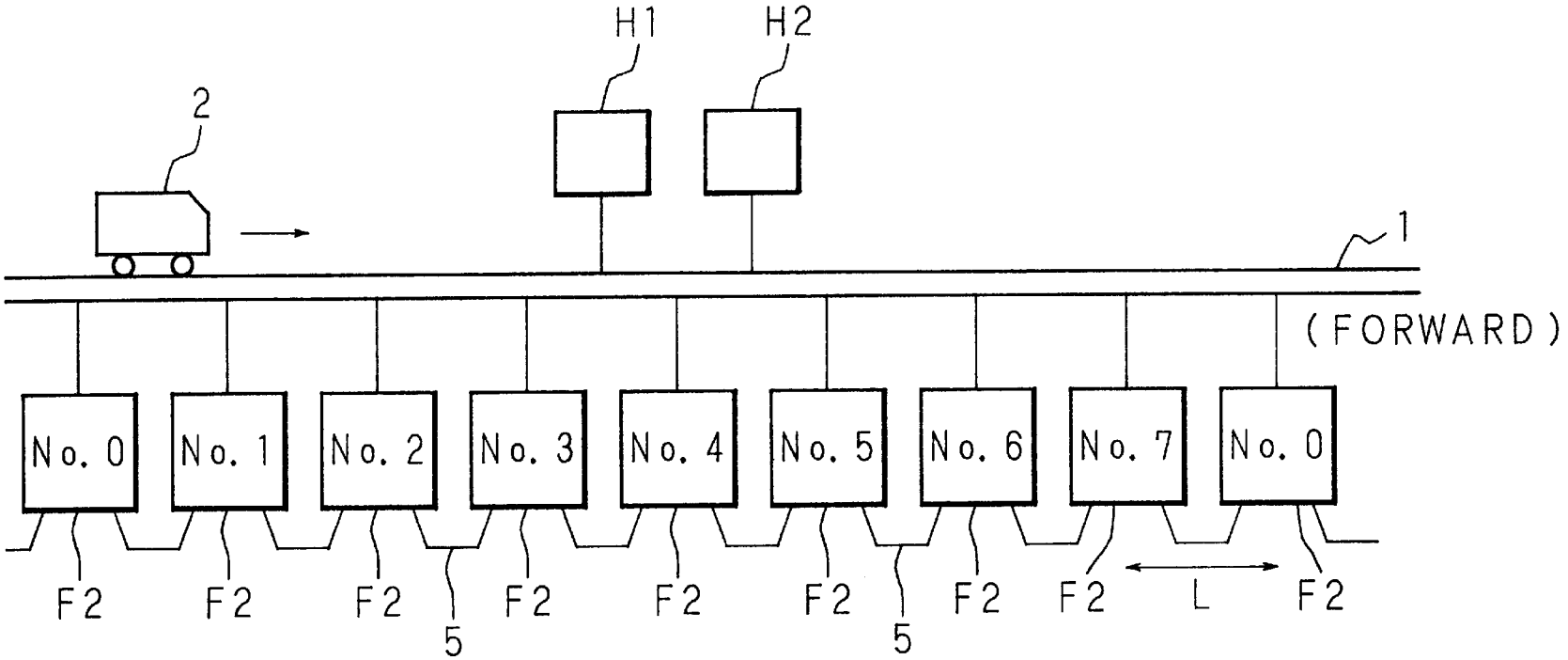
FIG. 28 is a schematic view showing an example of the overall structure of a seventh embodiment of the train-location detection system according to the present invention.

A seventh embodiment will now be described in which a train-detection/transmission apparatuses F2 each having both of the functions of the train-approach-detection/forward-transmission apparatus and the train-passage-detection/rearward-transmission apparatus. The description is made with reference to FIG. 28 which is a schematic view showing a state in which the train-detection/transmission apparatuses F2 are disposed at substantially the same intervals and FIG. 29 which is a block diagram showing the detailed structure. This embodiment has a structure that a near train can be detected even if the train is stopped.

Figure 29:
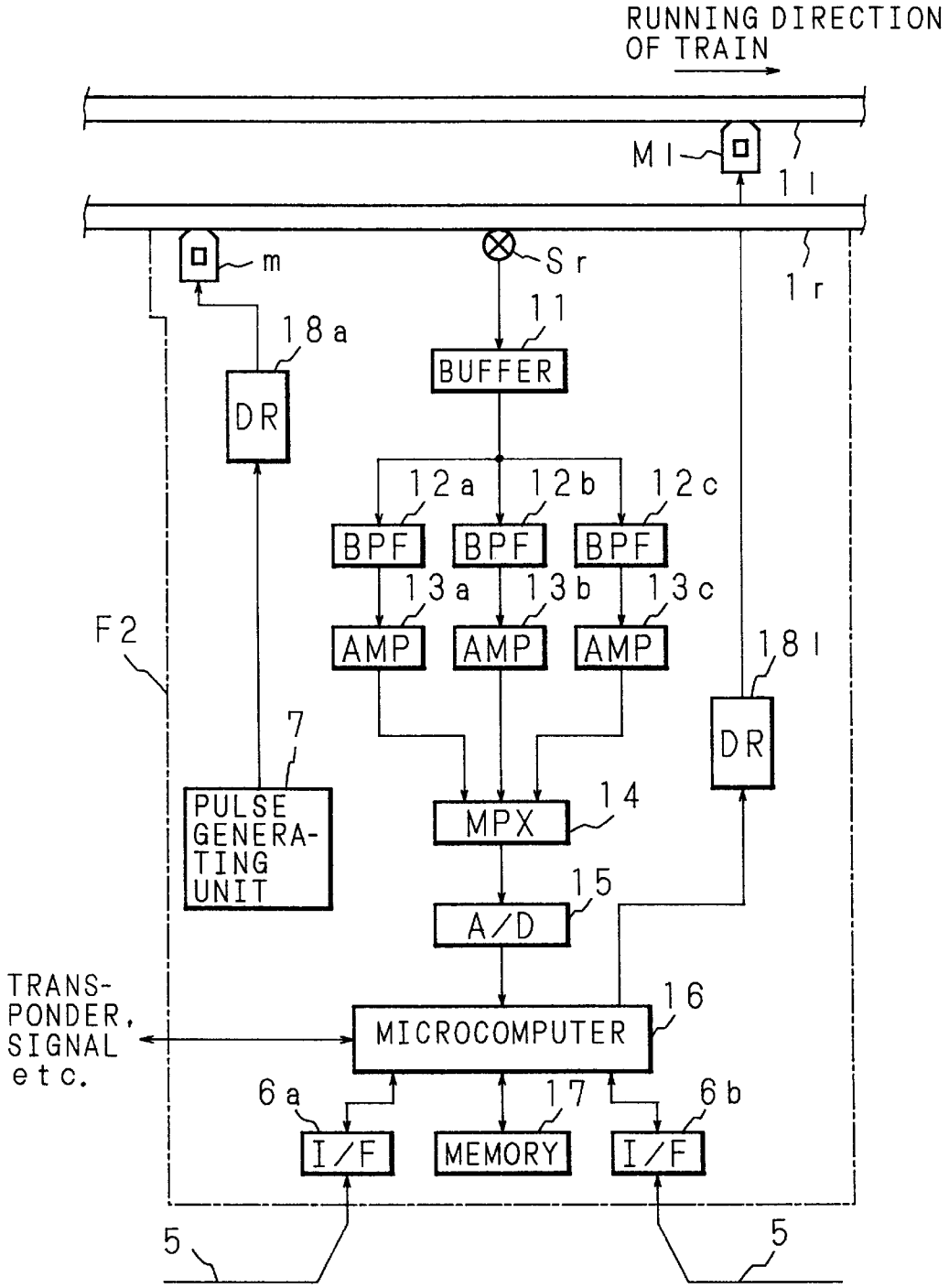
FIG. 29 is a block diagram showing an example of the structure of each train detection apparatus of the seventh embodiment of the train-location detection system according to the present invention.

Referring to FIG. 29, symbol m represents a magnetostrictive oscillator capable of easily generating high frequency waves, the magnetostrictive oscillator m being disposed a short distance, for example, about 20 m apart from the acceleration sensor Sr. Reference numerals 6*a* and 6*b* represent interface portions for communicating data to forward and rear stations by using a cable 5 in the form of a twisted pair capable. Reference numeral 7 represents a pulse generating circuit and 18*a* represents a driver for the magnetostrictive oscillator a A detection operation when the running train 2 reaches is at a very near location is performed by measuring oscillations having frequencies in the vicinity of 1 kHz and 5.5 kHz similarly to the first, second and fifth embodiments. If the running train 2 approaches at very low speed and then passes through, or if the running train 2 is stopped, the train 2 generates very small oscillations. Even in the above-mentioned state, the magnetostrictive oscillator m generates pulse elastic waves having high frequencies to detect passage of the train 2. Then, the elastic waves having the high frequencies are allowed to pass through the narrow band pass filter 12*e*.

Figure 30:
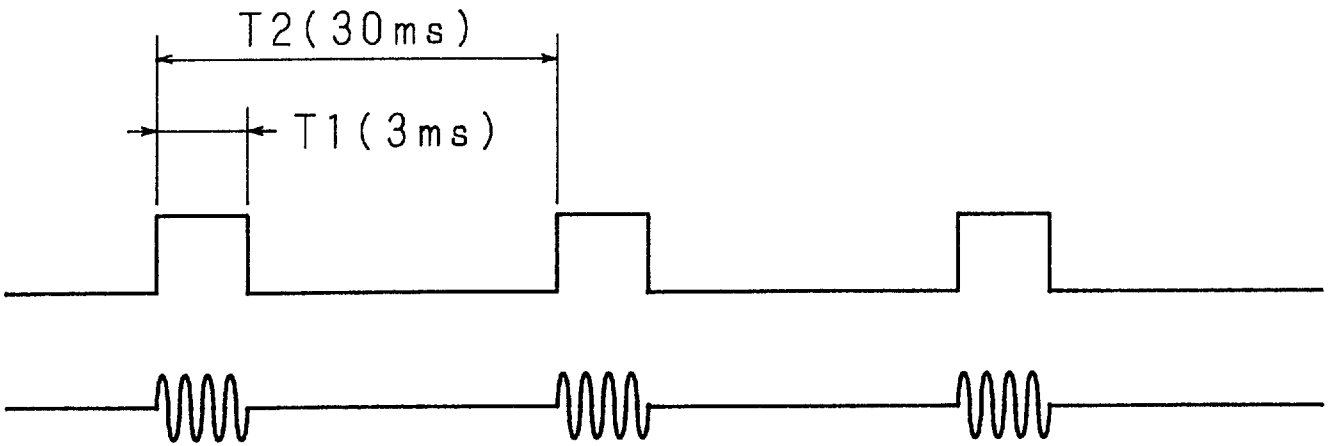
FIG. 30 is a timing chart showing an example of a state of generation of an elastic wave having a high frequency and generated by a magnetostrictive oscillator of the seventh embodiment of the train-location detection system according to the present invention.

FIG. 30 is a timing chart showing an example of a state in which the elastic wave having the high frequencies are generated by the magnetostrictive oscillator m. In this example, elastic waves are generated from the magnetostrictive oscillator m at cycles of T2 which is 30 ms for a period of T1 (3 ms). Note that the frequency of the elastic wave is, for example, about 10 kHz.

When the wheels of the train 2 are moved to the positions between the magnetostrictive oscillator m and the acceleration sensor Sr, the elastic waves generated by the magnetostrictive oscillator m are propagated toward the train 2. Therefore, the waveforms of the elastic waves which are detected by the acceleration sensor Sr are considerably changed. By using the above-mentioned principle, detection can be performed even if the train 2 runs at a very low speed or if the train 2 is stopped. Specifically, the running train 2 is detected as follows.

(1) When oscillations having the frequencies in the vicinity of 1 kHz have continuously been enlarged, determination can be made that the running train 2 exists at a near location. When oscillations having the frequencies in the vicinity of 5.5 kHz have continuously been enlarged, determination can be made that the running train 2 exists at very near location.

(2) If oscillations having the frequencies in the vicinity of 1 kHz are small, a determination can be made that the train 2 exists between the magnetostrictive oscillator m and the acceleration sensor Sr in a case where the height of the waves of the elastic wave pulses generated by the magnetostrictive oscillator m have continuously be changed That is, a determination can be made that the train 2 exists at a very near location. Since the distance from the magnetostrictive oscillator m to the acceleration sensor Sr is a very short distance of about 20 m, the frequencies of the elastic waves which is difficult to be propagated through the rail 1 must be selected. As a result, interference among the train detectors can be prevented.

If the running train 2 exists at a very near location, there is a strong probability that the elastic wave pulses generated by the magnetostrictive oscillator m are made to disappear by oscillations generated by the train 2. Therefore, detection cannot be performed by 38 only the method (2).

The detection method additionally provided with the magnetostrictive oscillator m and according to the present invention which is arranged to detect in a case where the train 2 exists at a very near location has the structure that the magnetostrictive oscillator m generates the elastic waves having frequencies in the vicinity 3 kHz which is considerably different from the frequencies generated by the running train 2. Therefore, combination of the first, second and the fifth embodiments does not raise any problem.

Figure 31:
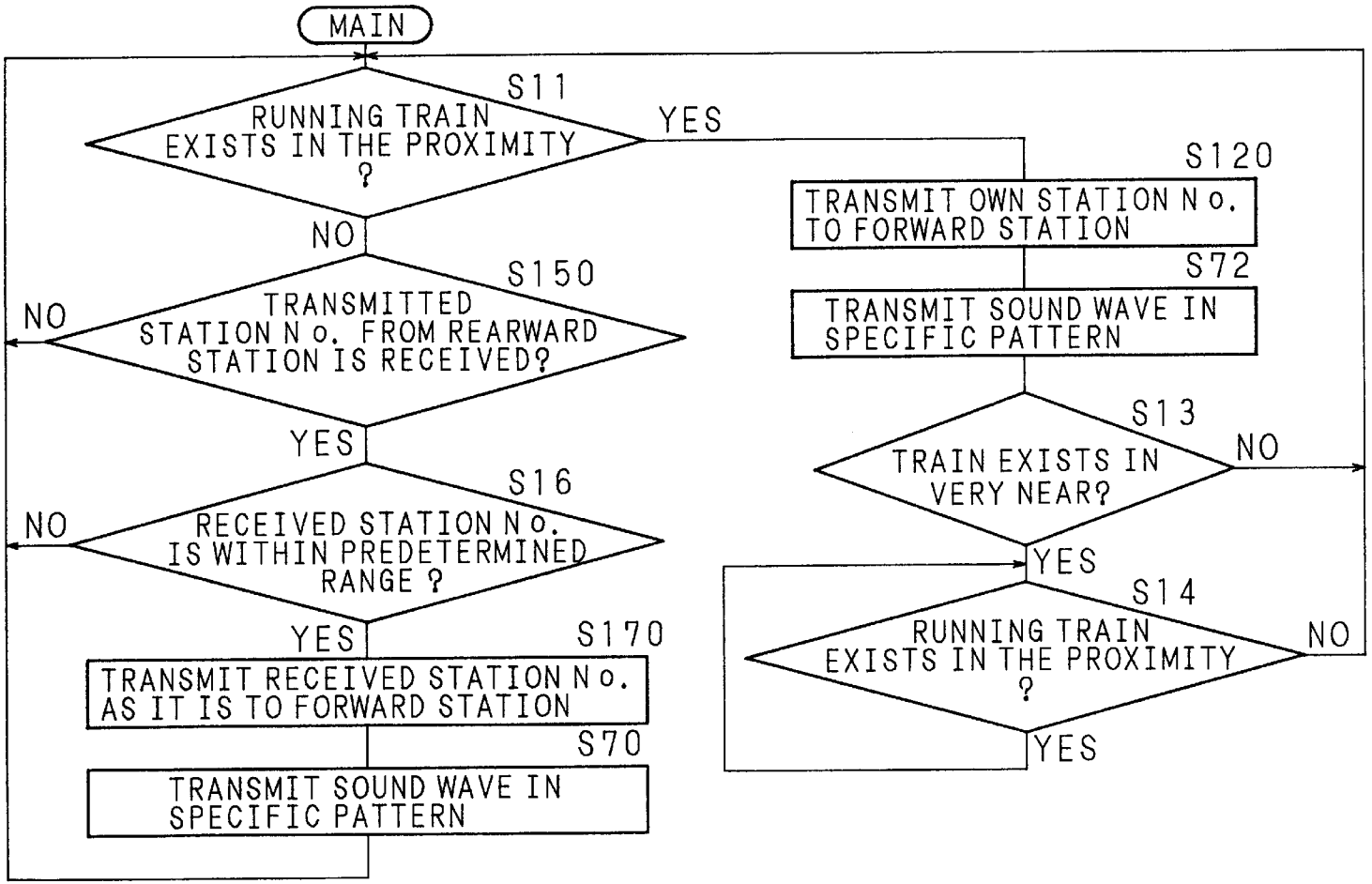
FIG. 31 is a flow chart showing a process of control which is performed by a microcomputer of the seventh embodiment of the train-location detection system according to the present invention.

The overall operation will now be described. The control process which is performed by the microcomputer 16 to realize the train-approach-detection/forward-transmission shown in FIG. 31 which is a flow chart is basically the same as that according to the first embodiment shown in FIG. 12. The control process which is performed by the microcomputer 16 to realize the train-passage-detection/rearward-transmission shown in FIG. 32 which is a flow chart is basically the same as the flow chart according to the second embodiment shown in FIG. 17.

The seventh embodiment is different from the first and second embodiments in an electric cable 5 for transmitting data. Therefore, the magnetostrictive oscillator M1 transmits sound wave signals in a specific pattern so as to propagate information on a train-approach through the rail 1. Specifically, in the flow chart shown in FIG. 31, step S120 for transmitting data of the station No. thereof to a forward station is performed in place of step S12 in the flow chart according to the first embodiment shown in FIG. 12. In place of step S15, step S150 is performed for determining whether or not data of the station No. has been received from a rear station. In place of step S17, step S170 is performed for transmitting data of the station No. received from a rear station No. to the forward station. In place of step S18, step S71 is performed for transmitting sound wave signals in a specific pattern by using the magnetostrictive oscillator M1. Moreover, step S72 for carrying out a process similar to that in step S71 is performed between steps S12 and S13.

Figure 32:
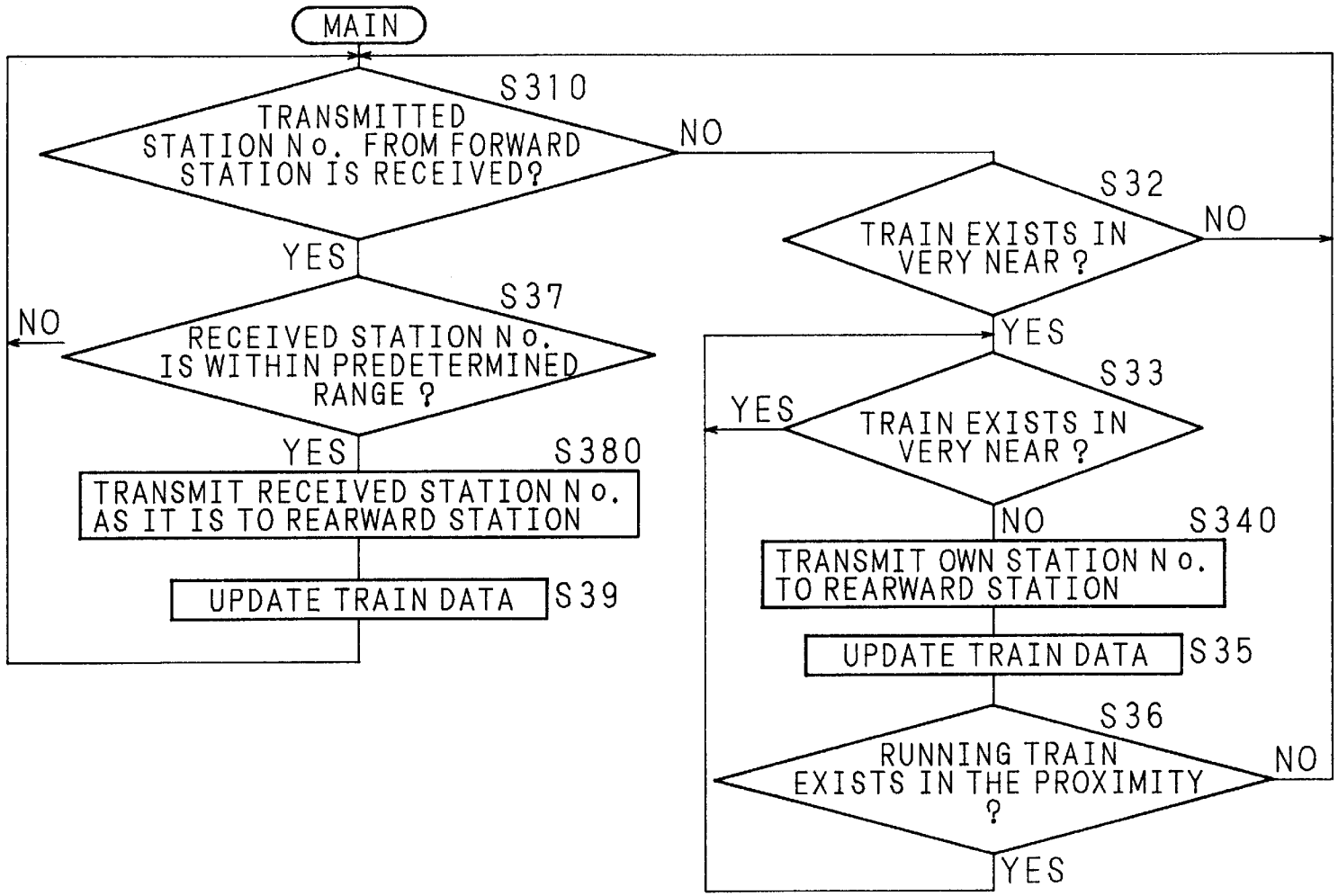
FIG. 32 is a flow chart showing a procedure of control which is performed by the microcomputer of the train-location detection apparatus of the seventh embodiment of the train-location detection system according to the present invention.

In the flow chart shown in FIG. 32, step S310 is performed for determining whether or not data of the station No. has been received from a forward station in place of step S31 in the flow chart according to the second embodiment shown in FIG. 17. In place of step S34, step S340 is performed for transmitting data of the station No. thereof to a rear station. In place of step S38, step S380 is performed for transmitting data of the station No. received from a forward station to a rear station.

Reference numerals H1 and H2 represent train-approach-alarm generating apparatuses having similar structures, functions and operations to those of the train-approach-alarm generating apparatuses shown in FIG. 11. The process which is performed by the microcomputer 16 is arranged so that the condition under which the buzzer 19 sounds is receipt of the above-mentioned specific pattern in place of receipt of data of the station No. in the form of the sound wave signal.

As described above, the train detection apparatus, the train-location detection system and the train-approach-alarm generating apparatus according to the present invention are arranged to use sound waves and capable of determining whether the train exists at a very near location or a more distant location Therefore, the cost can be reduced as compared with the conventional track circuit which requires an insulating portion formed by cutting the rail.

Since the sound wave signal is propagated through the rail to communicate the location of the train to the apparatus, no signal cable is required. Thus, the cost can be reduced.

Since a train which is running at a very low speed or a stopped train which generates substantially no oscillations cannot be detected, the sound wave signal is generated so as to receive the reflected wave. Thus, the detection is performed positively.

Since the train-approach-alarm generating apparatus can temporarily be provided for a rail at an arbitrary position, a portable and movable structure can be realized.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A train detection apparatus, comprising:

first detecting means for detecting a first frequency component;

second detecting means for detecting a second frequency component; and determining means for determining whether the train exists within a first predetermined distance which is a very near location or whether the train exists within a second predetermined distance which is more distant than said first predetermined distance based on results of detection performed by said first and second detecting means, wherein said first frequency component and said second frequency component are frequency components of elastic waves that are created and transmitted by the rails when the train runs on the rails and wherein said first frequency component is relatively easily propagated through the rail and said second frequency component is relatively more difficult to transmit through the rail.

2. A train detection apparatus as set forth in claim 1, further comprising:

sound-wave generating means for generating a sound wave having a third frequency which is different from said first and second frequencies so as to propagate said third frequency through the rail;

third detecting means for detecting said third frequency among the oscillations which are propagated through the rail; and signal-generating means for causing said sound-wave generating means to generate a pulse-shape sound wave signal corresponding to a result of the determination made by said determining means; wherein said determining means determines the location of the train in accordance with a result of the detection performed by said third detecting means.

3. A train detection apparatus as set forth in claim 1, further comprising:

sound-wave generating means for generating a sound wave having a fourth frequency which is different from said first and second frequencies so as to propagate said fourth frequency through the rail; and fourth detecting means for detecting said fourth frequency after being reflected by the train; wherein said determining means determines whether the train exists within a third predetermined distance which is a very near location in accordance with a result of the detection performed by said fourth detecting means regardless of the results of detection performed by said first and second detecting means.

4. A train-approach-alarm generating apparatus, comprising:

first detecting means for detecting a first frequency component;

second detecting means for detecting a second frequency component;

determining means for determining whether the train exists within a first predetermined distance which is a very near location or whether the train exists within a second predetermined distance which is more distant than said first predetermined distance based on results of detection performed by said first and second detecting means; and alarm-generating means for generating an alarm when said determining means has determined that the train exists within said first predetermined distance or said second predetermined distance, wherein said first frequency component and said second frequency component are frequency components of elastic waves that are created and transmitted by the rails when the train runs on the rails and wherein said first frequency component is relatively easily propagated through the rail and said second frequency component is relatively more difficult to transmit through the rail.

5. A train-location detection system including a plurality of train detection apparatuses which are disposed along rails and each of said train detection apparatuses comprises:

first detecting means for detecting a first frequency component;

second detecting means for detecting a second frequency component;

sound-wave generating means for generating a sound wave having a third frequency which is different from said first and second frequencies so as to propagate the third frequency through the rail;

third detecting means for detecting said third frequency among the oscillations which are propagated through the rail;

determining means for determining whether the train is approaching within a first predetermined distance which is a very near location or whether the train is approaching within a second predetermined distance which is more distant than said first predetermined distance, or whether the train exists within the first predetermined distance which is a very near location or whether the train exists within the second predetermined distance which is more distance than said first predetermined distance after the train has passed through in accordance with results of detection performed by said first and second detecting means; and signal-generating means for causing said sound-wave generating means to generate a pulse-shape sound wave signal corresponding to a result of the determination made by said determining means;

wherein said first frequency component and said second frequency component are frequency components of elastic waves that are created and transmitted by the rails when the train runs on the rails and wherein said first frequency component is relatively easily propagated through the rail and said second frequency component is relatively more difficult to transmit through the rail, wherein when said determining means of any one of said train detection apparatuses has detected the approach or the passage of the train, said signal-generating means of said train detection apparatus which has detected the approach or passage of the train applies a pulse-shape sound wave signal indicating detection of the approach or passage of the train to the rail, and said determining means of the other train detection apparatuses disposed ahead of said train detection apparatus which has detected the approach of the train in a direction in which the train runs or behind said train detection apparatus which has detected the passage of the train in the direction in which the train runs determine the location of the train in accordance with a result of the detection performed by said third detecting means.

6. A train-location detection system as set forth in claim 5, wherein said train detection apparatus, when said determining means of said train detection apparatus has determined the location of the train in accordance with the result of the detection performed by said third detecting means, causes said signal-generating means to generate a pulse-shape sound wave signal corresponding to the location of the train and to apply the pulse-shape sound wave signal to the rail.

7. A train-location detection system as set forth in claim 5, in which each of said train detection apparatus further comprises:

sound-wave generating means for generating a sound wave having a fourth frequency which is different from said first and second frequencies so as to propagate the sound wave through the rail; and fourth detecting means for detecting said fourth frequency after being reflected by the train; wherein said determining means determines whether the train exists within a third predetermined distance which is a very near location in accordance with a result of the detection performed by said fourth detecting means regardless of the results of detection performed by said first and second detecting means.

8. A train-approach-alarm generating apparatus for use in a train-location detection system, comprising:

first detecting means for detecting a first frequency component;

second detecting means for detecting a second frequency component;

third detecting means for detecting a third frequency component;

determining means for determining whether the train is approaching within a first predetermined distance which is a very near location or whether the train is approaching within a second predetermined distance which is more distant than said first predetermined distance in accordance with results of detection performed by said first detecting means and said second detecting means, or determining the location of the train in accordance with a result of the detection performed by said third detecting means; and alarm-generating means for generating an alarm when said determining means has determined that the train exists within the first predetermined distance or the second predetermined distance, or that the location of the train is a predetermined location in accordance with a result of the detection performed by said third detecting means, wherein said first frequency component and said second frequency component are frequency components of elastic waves that are created and transmitted by the rails when the train runs on the rails and wherein said first frequency component is relatively easily propagated through the rail and said second frequency component is relatively more difficult to transmit through the rail.

* * * * *